US006123041A

United States Patent [19]

Adamski, Jr. et al.

[11] Patent Number: 6,123,041

[45] Date of Patent: Sep. 26, 2000

[54] AUTOMATED SEWING SYSTEM AND METHOD FOR SEWING A KNIT GLOVE CUFF EDGE

[75] Inventors: Maximilian Adamski, Jr., Tega Cay, S.C.; J. Mark Smith, Lake in the Hills; Michael P. Faber, Crystal Lake, both of Ill.

[73] Assignee: Union Special Corporation, Del.

[21] Appl. No.: 09/483,333

[22] Filed: Jan. 14, 2000

Related U.S. Application Data

[60] Provisional application No. 60/116,127, Jan. 15, 1999.

[51] Int. Cl.[7] ..... D05B 19/12; D05B 21/00; D05B 35/06; D05B 65/02

[52] U.S. Cl. ..... 112/470.05; 112/470.07; 112/470.33; 112/288; 112/475.09; 112/475.26

[58] Field of Search ..... 112/470.05, 470.07, 112/470.29, 470.33, 475.08, 475.09, 63, 104, 306, 300, 475.17, 288, 475.26, 470.17; 2/161.6, 161.7, 161.8

[56] References Cited

U.S. PATENT DOCUMENTS 4,453,481 6/1984 Garnett et al. ..... 112/288
5,070,540 12/1991 Bettcher et al. ..... 2/161.6 X
5,125,351 6/1992 Prais et al. ..... 112/288 X
5,622,129 4/1997 Sahl ..... 112/470.29
5,850,792 12/1998 Adamski, Jr. et al. ..... 112/470.07

*Primary Examiner*—Peter Nerbun
*Attorney, Agent, or Firm*—John W. Habst

[57] ABSTRACT

An automated sewing system and method for overedge sewing a cuff edge of a knit glove to inhibit the glove cuff edge from unraveling is disclosed. The present invention permits an oversew pattern to be sewn into the seam thereby locking the stitches. The oversew pattern length and run-off angle is maintained consistent between workpieces and is predetermined. A length of thread chain extending from the sewn cuff edge and the length of thread chain remaining on the finished glove is automatically controlled by the present invention. Additionally, the present invention permits a label to be automatically inserted at a predetermined location into the sewn seam on the glove. Moreover, the present invention permits a tensioned elastic strip to be conjointly inserted into the sewn cuff edge thereby elasticizing the cuff edge of the glove.

48 Claims, 13 Drawing Sheets

FIG. 6
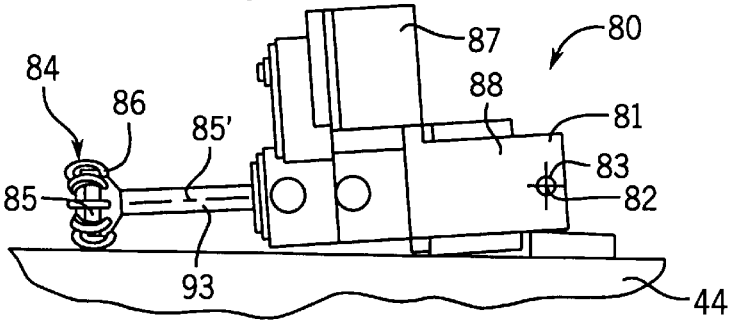
FIG. 7
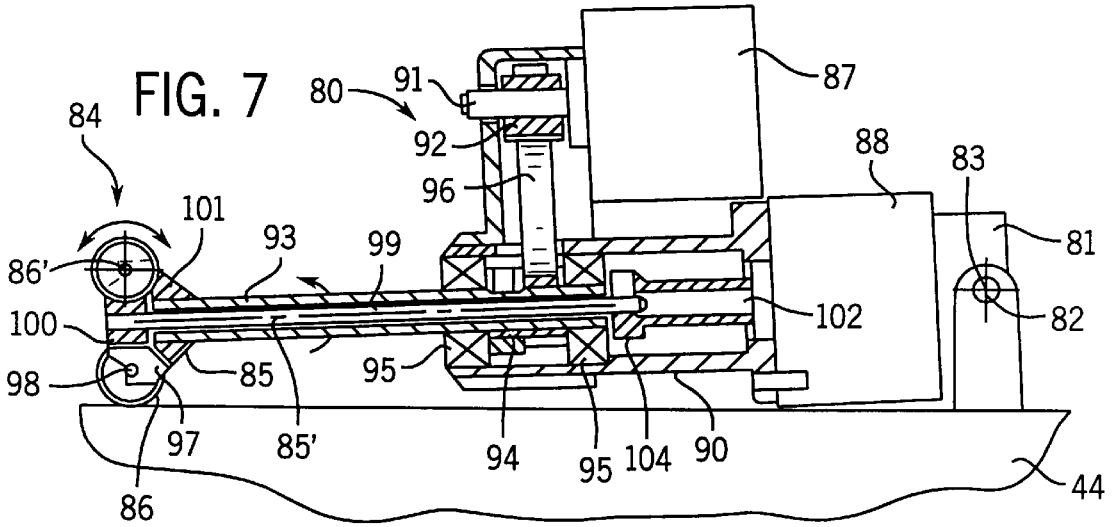
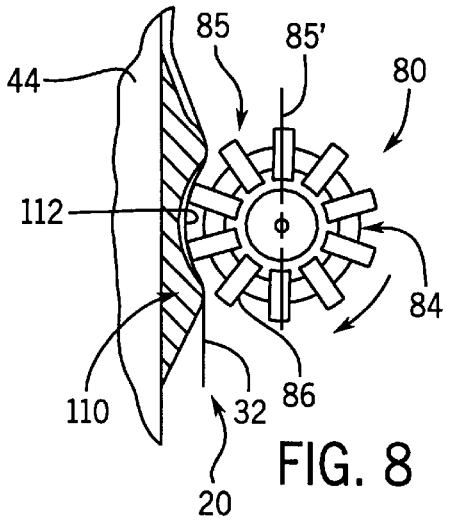
FIG. 8

FIG. 15
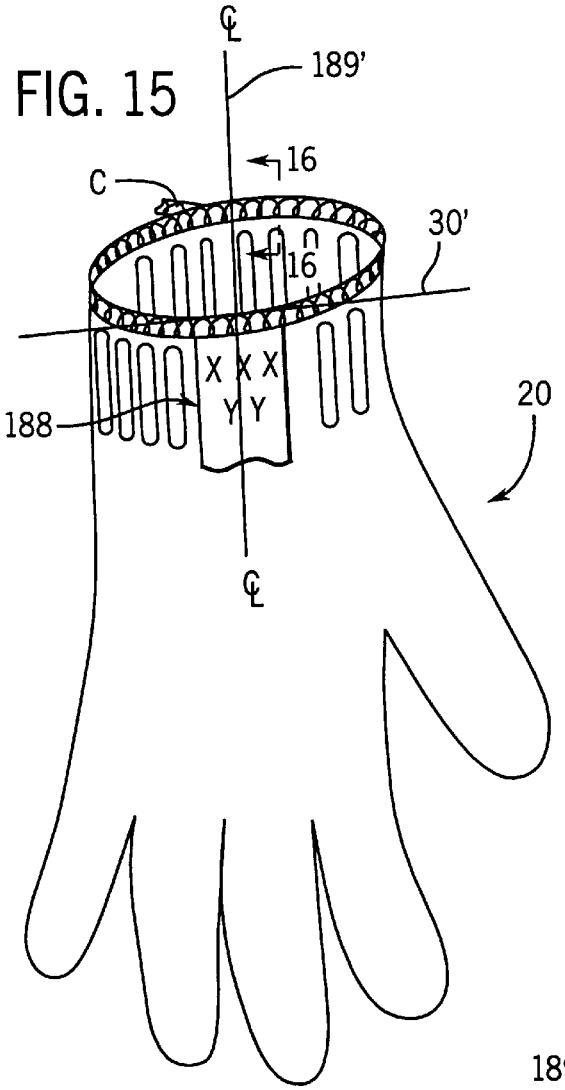
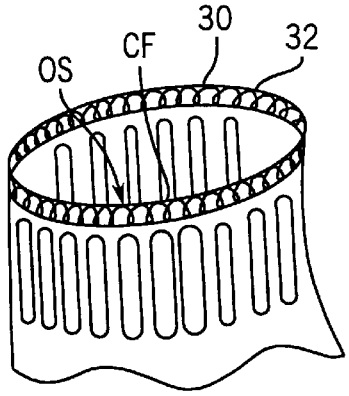
FIG. 14
FIG. 16
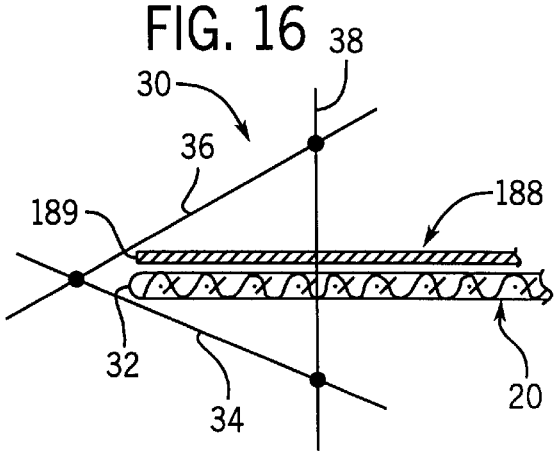
FIG. 19
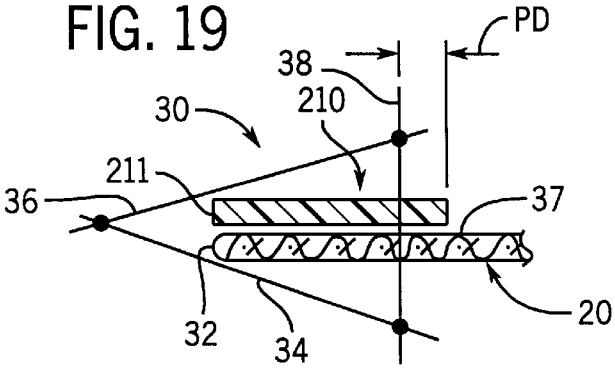

AUTOMATED SEWING SYSTEM AND METHOD FOR SEWING A KNIT GLOVE CUFF EDGE

This application claims benefit of Provisional Application No. 60/116,127 filed Jan. 15, 1999.

FIELD OF THE INVENTION

The present invention generally relates to sewing a cuff of a knit glove and, more particularly, to an automated sewing system and method for applying overedge stitching to a cuff edge of a knit glove so as to lock the stitching with a predetermined oversew pattern thereby inhibiting the knit glove from inadvertently unraveling and such that a consistent or predetermined length of thread chain extends from the sewn edge of the knit glove upon completion of the sewing process.

BACKGROUND OF THE INVENTION

The knitted gloves disclosed herein are industrial gloves used by people in their jobs to protect their hands. Of course, and as should be appreciated, the invention disclosed herein could be used to sew or serge a cuff opening on knitted gloves intended for uses other than industrial uses. Suffice it to say, knitted gloves are automatically manufactured as a one-piece article on knitting machines starting with the body, which may be configured with finger portions, and ending with a continuous sleeve or cuff opening. Because the glove is formed from a knitted material, however, the continuous sleeve or cuff opening must be protected to prevent unraveling of the knitted yarn.

Glove manufacturers are known to manually serge or overedge the cuff edge or wrist opening of knit gloves using a conventional sewing machine having stitching instrumentalities capable of producing overedge stitching along the cuff edge. To accomplish this operation, the operator loads the glove onto the sewing machine and manually guides and assists in feeding the glove through a sewing cycle. As the raw cuff edge is fed toward and through the sewing instrumentalities of the sewing machine, the operator must be continually vigilant to maintain the cuff edge in relatively constant relation relative to the stitching instrumentalities to ensure the cuff edge is properly serged. Of course, if the operator is not vigilant or lacks the skills necessary for properly serging the cuff edge, the raw edge of the cuff can be overfed, thus, causing an unacceptable roll in the cuff edge resulting in a rejectable work product.

As the end of the sewing cycle approaches, and the sewn cuff edge is again presented to the sewing instrumentalities, the operator sews over the sewn cuff edge thereby overlapping the beginning or leading stitches in the stitches in the seam to "lock" the stitching in place. In heretofore known operations, the operator decides the extent of overlap or oversew of the sewn cuff edge. Moreover, the operator decides when the sewn cuff edge is to be laterally removed from beneath a presser foot on the sewing machine to allow the sewing instrumentalities to sew off the cuff edge. That is, at the completion of the sewing cycle, the operator laterally removes the sewn cuff edge from beneath a presser foot on the sewing machine and thereafter continues to operate the machine thereby creating a thread chain extending between the sewn cuff edge of the knitted glove and sewing instrumentalities on the sewing machine. Of course, to release the sewn glove from the sewing machine, the thread chain extending between the sewn cuff edge and the sewing instrumentalities must be manually severed or cut.

An acceptable glove product requires the thread chain extending from the cuff edge to be very short, typically only one-quarter of an inch or less is allowed. Accordingly, the thread chain extending from the sewn cuff edge must be manually severed or cut within approximately one-quarter inch of the sewn seam on the glove. Moreover, and shortly after the operator begins to serge another glove, the operator must interrupt the sewing operation to again manually sever the thread chain with a pair of scissors.

Sewing machines having mechanized thread chain cutting devices are readily available in the sewing industry. While such mechanized thread chain cutters are available, to sever the thread chain within only one-quarter of an inch of the sewn seam requires a highly skilled operator. In an effort to produce a short thread chain, the sewn seam of the glove cuff and sometimes the glove itself becomes entangled with the thread chain cutter, thus, producing an unacceptable workpiece or glove. As will be apparent from the above, the quality of sewing, the amount of oversew, the cycle time and the length of thread chain extending from the sewn cuff edge are all dependent on the operator's skill and judgment.

Often times, it is desirable to elasticize the cuff or wrist portion of an industrial glove. As such, a wearer's hand may be easily inserted into the glove and yet, the glove, when on the hand, will fit closely around the cuff or wrist of the wearer. As such, and in environments involving dirt or the like, debris will not readily pass into the glove. In this regard, a continuous band of elastic has been known to be attached about the cuff edge. Heretofore, attachment of the elastic or rubber band was accomplished as an independent function separate from the overedge or serging operation discussed above. Thus, the addition of such elastic or rubber band adds considerably to the overall cost of the glove. Again, and as will be readily appreciated, independent attachment of a continuous elastic or rubber band about the wrist portion of a sewn cuff requires an operator having both skill and experience to accomplish this labor intensive task.

In addition to those features mentioned above, some glove manufacturers desire a label to be sewn into the overedge seam and along the cuff edge. Although desirable, several problems are presented when a label is to be sewn into the overedge seam and along a cuff edge of the glove. First, little or no variance is permitted regarding placement of the label location along the overedge seam. Preferably, the label is centered along the sewn cuff edge. Second, the label must extend generally normal or perpendicular to the to the cuff edge. Moreover, the label should be consistently secured across its entire width by the overedge seam extending along the sewn cuff edge. Additionally, the presence of the label on the cuff edge should not significantly increase costs of the glove.

Heretofore, insertion of the label along the sewn cuff edge required an operator to begin sewing the cuff edge and then visually assess where to manually insert the label. After assessing the location for label insertion, the sewing machine is stopped and the label is manually inserted under the presser foot. Thereafter, sewing is resumed with the label being secured in place by the sewing instrumentalities of the sewing machine. Of course, and upon resumption of the sewing process, the label often inadvertently shifts and is sewn into the cuff edge seam in other than normal or perpendicular relation to the sewn seam and is skewed with respect to the cuff edge. As discussed above with respect to both sewing the cuff edge and elasticizing the sewn cuff edge, requiring insertion of a label into the sewn cuff edge furthermore requires manual skill and lengthy experience on the part of the operator to accomplish proper positioning and sewing of the label. Of course, improper positioning or sewing of the label into the sewn cuff edge of a knit glove diminishes the quality of the glove product while increasing the number or volume of products which must be rejected for failure to meet quality standards of most glove manufacturers.

Thus, there is a need and a desire for a system and method for automating the process of serging or overedge sewing a cuff edge of a knit glove to inhibit the glove from inadvertently unraveling and such that a thread chain of consistent predetermined length extends from the sewn cuff edge of the knit glove. Moreover, there is a need and a desire for an apparatus and method for automating the process of serging or overedging a cuff edge of a knit glove and whereby the cuff edge can be elasticized and may further include a label inserted within the sewn cuff edge.

SUMMARY OF THE INVENTION

In view of the above, and in accordance with one aspect of the present invention, there is disclosed an automated system for applying stitching to a continuous cuff edge of a knit glove to inhibit the cuff edge from unraveling. Regarding this aspect of the invention, the sewn cuff edge is locked by sewing over the leading edge of the sewn cuff edge a predetermined distance while furthermore providing a predetermined and consistent length of thread chain remaining and extending from the sewn cuff edge at the completion of the automated sewing process.

According to this first aspect of the invention, the automated sewing system includes a sewing station whereat the cuff edge of said glove is sewn. The sewing station includes a sewing machine having a rotatable handwheel and sewing instrumentalities for applying overedge stitching to a raw cuff edge of the glove as the glove cuff edge moves along a predetermined path of travel to create a sewn cuff edge thereby inhibiting said cuff edge from unraveling. The sewing machine further includes a driven cutting assembly positioned adjacent the sewing instrumentalities. The automated sewing system also includes a first apparatus arranged upstream of said sewing station for automatically positioning the edge of the glove in a direction extending generally normal to the predetermined path of travel of the glove cuff edge. A control system is operably connected to and controls the first apparatus and the sewing machine to progressively advance the edge of said glove through said sewing machine until a leading portion of the sewn cuff edge is sewn over in an oversew pattern a predetermined distance by said stitching instrumentalities. A salient feature of the present invention involves having the control system operate the sewing machine and the first apparatus after the sewn cuff edge is sewn over the predetermined distance to automatically remove said sewn cuff edge from the predetermined path of travel. As such, and according to this aspect of the invention, as the sewing machine continues to operate in the oversew pattern a line of stitching "runs off" the cuff edge at a predetermined and consistent angle while creating a chain of stitches extending from the sewn cuff edge. The chain of stitches extending from the sewn cuff edge is drawn toward the cutting assembly and severed a predetermined distance from the sewn cuff edge.

In a preferred form of the invention, the automated sewing system furthermore includes a pusher apparatus arranged adjacent the sewing station. The purpose of the pusher apparatus is to assist the first apparatus in laterally and automatically moving or ejecting the sewn cuff edge relative to the predetermined path of travel. The pusher apparatus is connected to and controlled by the control system of the automated sewing system.

As is conventional, the glove to which the overedge stitching is applied includes a body portion extending away from the cuff edge. In most gloves, the body portion of the glove is configured with a series of fingers. Depending on the size and type of glove to be automatically sewn, the automated apparatus of the present invention can furthermore include a glove expansion assembly. The purpose of the expansion assembly is to automatically expand the body portion of the glove to a predetermined size thereby facilitating advancement of the cuff edge through the sewing station. In a preferred form, the expansion assembly includes a carrier about which the glove cuff edge is at least partially passed prior to extension of the body portion of the glove. In a most preferred form, the expansion assembly furthermore includes a driver for moving the carrier relative to the sewing instrumentalities and in timed relation to operation of the sewing machine.

To overcome the heretofore known problem of inconsistency, the control system of the automated apparatus includes electronics for controlling operation of the sewing station thereby ensuring the sewn cuff edge is sewn over a consistent predetermined distance. To yield flexibility, the control system of the present invention is preferably programmable thereby yielding selective control over the predetermined distance the sewn cuff edge is sewn over. In the preferred form of the invention, the control system monitors rotation of the handwheel as the cuff of the glove is sewn.

To furthermore minimize operator involvement with the process of serging or sewing the cuff edge of the knitted glove, a preferred form of automated apparatus of the present invention includes an apparatus for automatically removing or ejecting the sewn glove from the sewing station. As such, and after the glove is initially loaded onto the sewing system of the present invention, the entire process for sewing the cuff edge, including removal of the sewn glove from the sewing station, is automated and requires minimal operator involvement.

Another aspect of the present invention involves providing a puller apparatus in combination with the automated apparatus. The puller apparatus is arranged downstream of the stitching instrumentalities for operably moving the sewn cuff edge through the sewing station. With this aspect of the invention, the line of stitching in the oversew pattern remains "in line" with the sewn cuff edge as compared to the "run off" of the stitches in the embodiment discussed above.

The control system for this aspect of the invention is furthermore connected to and operates the puller apparatus. As discussed above, the system controls the sewing machine and other components of the automated system to advance a raw edge of the glove along the predetermined path of travel and through the sewing machine until a leading portion of the sewn cuff edge has been sewn over thereby locking the stitching in place and, thus, inhibiting inadvertent unraveling of the sewn cuff edge. Thereafter, the system operates the sewing machine and the pusher apparatus to remove the sewn cuff edge from the predetermined path of travel after the sewn edge has been sewn over the predetermined distance. After removing the sewn cuff edge from the predetermined path of travel, the system operates the sewing machine and the puller apparatus to create slack in the sewn cuff edge thereby allowing a chain of overedge stitches extending from the sewn cuff edge to be drawn toward and severed by the chain cutter a predetermined distance from the sewn cuff edge. Notably, however, the line of sewing in the oversew pattern on the sewn cuff edge remains in line with the cuff edge as compared to angling off toward the cuff edge as discussed above.

In this alternative form of the invention, the puller apparatus can take a myriad of designs. In a preferred form, however, the puller apparatus comprises a puller roller positioned adjacent to the sewing instrumentalities. A driver operably and, preferably, positively rotates the puller roller in opposite directions. When the puller roller rotates in a first direction, the puller roller serves to move the sewn edge along the predetermined path of travel and through the sewing machine. When operated in a second direction, the puller roller causes slack in that portion of the sewn cuff edge disposed between the puller roller and the sewing instrumentalities. In a most preferred form, the driver comprises a motor operable in opposite rotational directions.

Another aspect of the present invention involves inserting an elastic strip into the sewn cuff edge thereby elasticizing the cuff edge. In this form of the invention, the sewing station includes the sewing machine and a driven apparatus for directing a strip of tensioned elastic strip to the sewing instrumentalities of the sewing machine in a manner permitting the elastic strip to be attached to the cuff edge. As such, the sewn cuff edge is inhibited from inadvertent unraveling as well as being elasticized to snugly fit about the wrist portion of the person wearing the glove.

In a most preferred form of the invention, the presser foot on the sewing machine is specifically configured to permit a portion of the elasticized strip to extend past the stitching along the sewn cuff edge. As such, the glove is presented with an aesthetically pleasing appearance and design. Furthermore, having a portion of the elasticized strip extend past the stitching on the sewn cuff edge assures proper securement of the elasticized strip within the overedge sem on the glove cuff edge.

Still another aspect of the present invention involves an automated method of sewing a continues cuff edge of a knit glove to inhibit the cuff edge from inadvertently unraveling. Such a method of sewing comprises the step of: moving a raw edge of the glove cuff along a predetermined path of travel toward a sewing station. The sewing station includes a sewing machine with stitching instrumentalities and a driven vacuum operated cutting assembly positioned adjacent the sewing instrumentalities for cutting threads. The automated method further involves the step of guiding a raw edge of the glove automatically along the predetermined path of travel and relative to the stitching instrumentalities. The automated method of the present invention furthermore involves controlling the sewing machine to progressively apply an interlocked stitching pattern to the raw edge of the glove as the cuff edge passes through the sewing machine to create a sewn cuff edge thereby inhibiting the cuff edge from inadvertently unraveling, and wherein the application of interlocked stitches continues until a leading portion of the sewn cuff edge is sewn over a predetermined distance by the stitching instrumentalities. A salient feature of the preferred method comprises the step of removing the sewn cuff edge from said predetermined path of travel after the sewn cuff edge is sewn over the predetermined distance; and continuing operation of the sewing machine after the sewn cuff edge is removed from the predetermined path of travel to create a chain of stitches extending from the sewn cuff edge, and wherein said chain of stitches is drawn toward the cutting assembly and severed a predetermined distance from the sewn cuff edge.

During research, and depending upon the type and size of glove, further adding the step of expanding a body portion of the glove to a predetermined size in timed relation relative to operation of said sewing machine has proven beneficial to the automated sewing method. More specifically, research has shown expanding the body portion of the glove to a predetermined size relative to operation of the sewing machine facilitates movement of the cuff edge through the sewing machine. Moreover, monitoring operation of the sewing machine to control the predetermined distance the leading edge of said sewn cuff edge is sewn over has also proven advantageous to the automated method of sewing a knitted glove. In a preferred form of the invention, the automated method further includes the step of: programming operation of the sewing machine to control the predetermined distance the leading edge of said sewn cuff edge is sewn over. To furthermore minimize operator involvement, the preferred method of sewing a knitted glove furthermore comprises the step of ejecting the knit glove with the sewn cuff edge from the sewing station after the chain of stitches is severed.

An alternative methodology of sewing the knit cuff edge of a knit glove involves maintaining the oversew pattern in line with the overedge stitching on the glove. This alternative methodology employs many of the same steps mentioned above and in addition involves pulling the sewn cuff edge from the sewing machine in a first direction extending generally parallel to the predetermined path of travel of the cuff edge with the a puller apparatus. After the leading sewn cuff edge is sewn over a predetermined distance, a salient feature of this methodology involves evicting the sewn cuff edge approaching the sewing instrumentalities from the predetermined path of travel followed by continuing operation of the sewing machine while creating slack in that portion of the sewn cuff edge between the puller apparatus and the sewing instrumentalities to create a chain of stitches extending from the sewn cuff edge. The chain of stitches is naturally drawn toward the vacuum operated chain cutter and severed a predetermined distance from the sewn cuff edge without harming the sewn cuff edge or the glove.

In this alternative methodology, the step of creating slack in that portion of the sewn cuff edge disposed between the puller apparatus and the sewing instrumentalities of the sewing machine is effected through reverse operation of the puller apparatus. That is, the puller apparatus is operated in a second direction opposed to the first direction to create slack in that portion of the sewn cuff edge disposed between the puller apparatus and the stitching instrumentalities on the sewing machine.

Still another methodology is disclosed for sewing a cuff edge of a knitted glove to inhibit the cuff edge from inadvertently unraveling. This alternative method involves elasticizing the sewn cuff edge. This alternative method involves the steps of either of the two methodologies discussed above. In addition, and as the raw cuff edge is being guided toward the sewing instrumentalities of the sewing machine, this alternative method involves elasticizing the cuff edge of the glove with a relatively narrow tensioned strip of elasticized material. The tensioned strip of elasticized material is sewn into and positioned immediately adjacent to the cuff edge sewn by the sewing instrumentalities.

The methodology discussed above can be further enhanced by inserting a label into the sewn cuff edge. The step of inserting the label is effected automatically during the sewing process such that consistency and preciseness are assured regarding label placement and orientation.

As will be appreciated from the above, a primary object of the present invention is to automate the process of protecting the cuff edge of a knitted glove to inhibit inadvertent unraveling of the glove.

Another object of the present invention involves automating the process of protecting the cuff edge of a knitted glove to inhibit inadvertent unraveling of the glove while insuring the stitching extending from the sewn cuff edge is automatically severed a predetermined distance from the sewn cuff edge.

Still a further object of this invention involves automating the process of protecting the cuff edge of a knitted glove to inhibit inadvertent unraveling of the glove while conjointly elasticizing the sewn cuff edge thereby causing the cuff to fit snugly about the wrist of the person wearing same.

Yet another object of the present invention involves automating the process of protecting the cuff edge of a knitted glove to inhibit inadvertent unraveling of the glove while allowing a label to be inserted automatically into the sewn cuff edge with preciseness and such that the orientation of the label is proper and consistent.

As will be appreciated from the above, and as a result of the present invention, the quality of oversew or serging, the amount of oversew, the length of thread chain extending from the sewn cuff edge, the length of the thread chain remaining on the finished glove, the cycle time and the accurate insertion of the label into the sewn cuff edge of the glove are all automatically controlled and optimized. Heretofore known processes involving the manual method of serging a knitted glove and which were totally dependent upon the operator's judgement and skill are, in accordance with the present invention, automatically controlled. Accordingly, operator involvement is minimized thereby reducing the manufacturing costs for the finished glove product. The finished glove product produced by the method of the present invention has a very short remaining chain length. The run-off angle of the remaining chain length can either be very shallow, thus, it does extend off from the sewn cuff edge or remain "in-line" with the sewn cuff edge. Moreover, the oversew length is minimized and, thus, remains constant with all finished glove products.

These and other additional objects, aims and advantages of the present invention will become readily apparent and appreciated from the following detailed description, the drawings and the appended claims.

BRIEF DESCRIPTION OF THE DRAWINGS

FIG. 6 is a bottom plan view of a material engaging head assembly forming part of the automated sewing system of the present invention;

FIG. 7 is a partial sectional view of the material engaging head assembly illustrated in FIG. 6;

FIG. 8 is a simplified side elevational view of the material engaging head assembly arranged in operative relationship relative to a sewing station forming part of the present invention;

FIG. 14 is an alternative work product which can be automatically produced in accordance with the teachings and principals of the present invention;

FIG. 15 is a sketch of a knitted glove having a serged or overedged cuff edge with a label being precisely inserted thereinto in accordance with alternative teachings and principals of the present invention;

FIG. 16 is an enlarged sectional view taken along line 16—16 of FIG. 15;

FIG. 19 is an enlarged sectional view schematically illustrating still another alternative work product capable of automatically being produced with the automated sewing system of the present invention;

DETAILED DESCRIPTION OF THE PRESENT INVENTION

Figure 1:
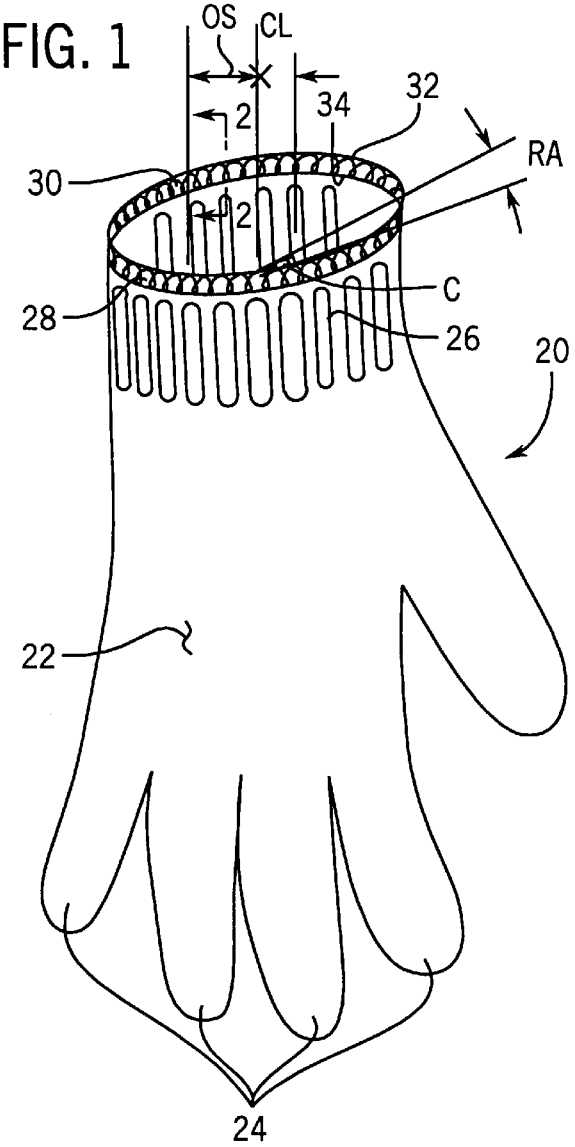
FIG. 1 is a sketch of a knitted glove having a cuff overedged or serged by the present invention.

While the present invention is susceptible of embodiment in several various forms, there is shown in the drawings and will hereinafter be described in detail preferred embodiments of the present invention with the understanding the present disclosure is considered as setting forth exemplifications of the invention which are not intended to limit or otherwise restrict the invention to the specific embodiments illustrated.

Referring now to the drawings, wherein like reference numerals indicate like parts throughout the several views, FIG. 1 schematically illustrates a knitted glove 20 produced on a conventional and well known automatic knitting machine as a one-piece product. Glove 20 includes a body portion 22, preferably including fingers 24, and a wrist portion 26 which terminates in a cuff 28. Of course, it is well within the spirit and scope of the present invention to configure the body portion 22 of the glove 20 as a mitten having no individual fingers. Because the glove 20 is formed from a knitted material, and to inhibit the cuff 28 from inadvertently unraveling, it is common to apply an overedge or interlocked stitching pattern 30 along the edge 32 of the cuff 28.

Figure 2:
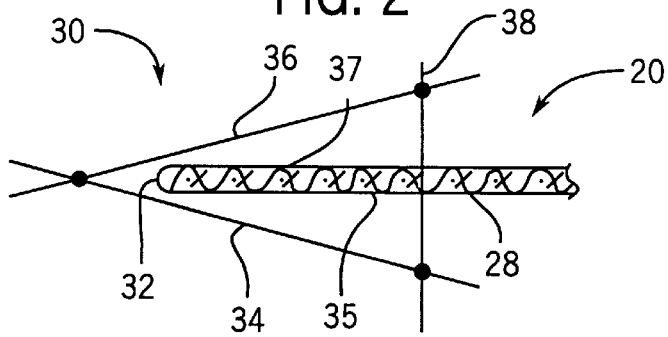
FIG. 2 is an enlarged sectional view taken along line 2—2 of FIG. 1 and schematically illustrating a cuff edge of the glove which has ben overedged or serged by the preferred method of the present invention.

As schematically illustrated in FIG. 2, the overedge stitching pattern 30 applied to the glove cuff 28 comprises a series of interlocked threads. In the exemplary embodiment, the interlocked or overedge stitching pattern 30 applied to the glove cuff 28 includes a lower looper thread 34, an upper looper thread 36, and at least one needle thread 38. As will be understood by those skilled in the art, the lower looper thread 34 extends inwardly from the glove cuff edge 32 and covers an inner surface 35 of the glove cuff 28. The upper looper thread 36 extends inwardly from the glove cuff edge 32 and covers an outer surface 37 of the glove cuff 28. Moreover, the needle thread 38 is spaced from the cuff edge 32 and is interlocked with both the lower and upper looper threads 34 and 36. As illustrated in FIG. 1, the overedge stitching pattern 30 extends about the entirety of the glove cuff 28 and inhibits the knitted glove from inadvertently unraveling.

In performing the prior art manual operation, an operator would load a glove onto an overedge sewing machine and would thereafter be required to manually guide and assist in feeding the glove through a sewing cycle. Immediately after the start of the sewing cycle, however, the operator would be required to stop the sewing machine in order to manually cut or sever the leading thread chain with scissors. After the thread chain is cut, sewing is resumed and the operator must manually and visually maintain the raw cuff edge of the glove in alignment relative to the sewing instrumentalities of the sewing machine to assure the cuff edge is completely filled or covered but not overfed, which would cause "rolling up" of the edge onto the serged or sewn cuff edge. As used herein, the term "sewing instrumentalities" refers at least to the threaded needle or needles of the sewing machine along with the lower thread handling mechanisms, i.e., upper and lower thread carrying loopers which are well known in the sewing industry.

As the operator approaches the end of the sewing cycle, it is preferable to "lock" the stitching at the beginning or lead edge of the sewn cuff with additional or oversewn stitching. Accordingly, and as the operator approaches the end of the sewing cycle, the operator must decide on how much or the extent of oversew pattern or overlap stitching to apply to the sewn cuff edge of the glove cuff. In FIG. 1, the oversew pattern or overlap of the leading sewn cuff edge is schematically represented by OS.

After the leading sewn edge of the glove has been oversewn, the operator needs to determine when to start to remove the sewn glove cuff from beneath a presser foot on the sewing machine so as to allow the glove cuff to be "sewn off"the machine, thus, creating a line of stitches or thread chain extending from the sewn cuff edge to the sewing instrumentalities on the sewing machine. As will be appreciated, the oversew pattern forms a run-off angle relative to the sewn cuff edge. In the manual operation, this run-off angle is determined by the angle at which the operator holds the glove relative to the line of stitching during the run-off sewing operation. Suffice it to say, it is desirable to maintain the run-off angle as shallow as possible. In FIG. 1, the run-off angle is identified by RA.

Of course, to completely remove the sewn glove from the sewing machine, the thread chain must be manually severed or cut. To produce an acceptable work product, the thread chain should be cut or severed as close as possible to the sewn cuff edge on the glove. In FIG. 1, the thread chain is identified by C and the remaining thread chain is identified by CL.

Figure 3:
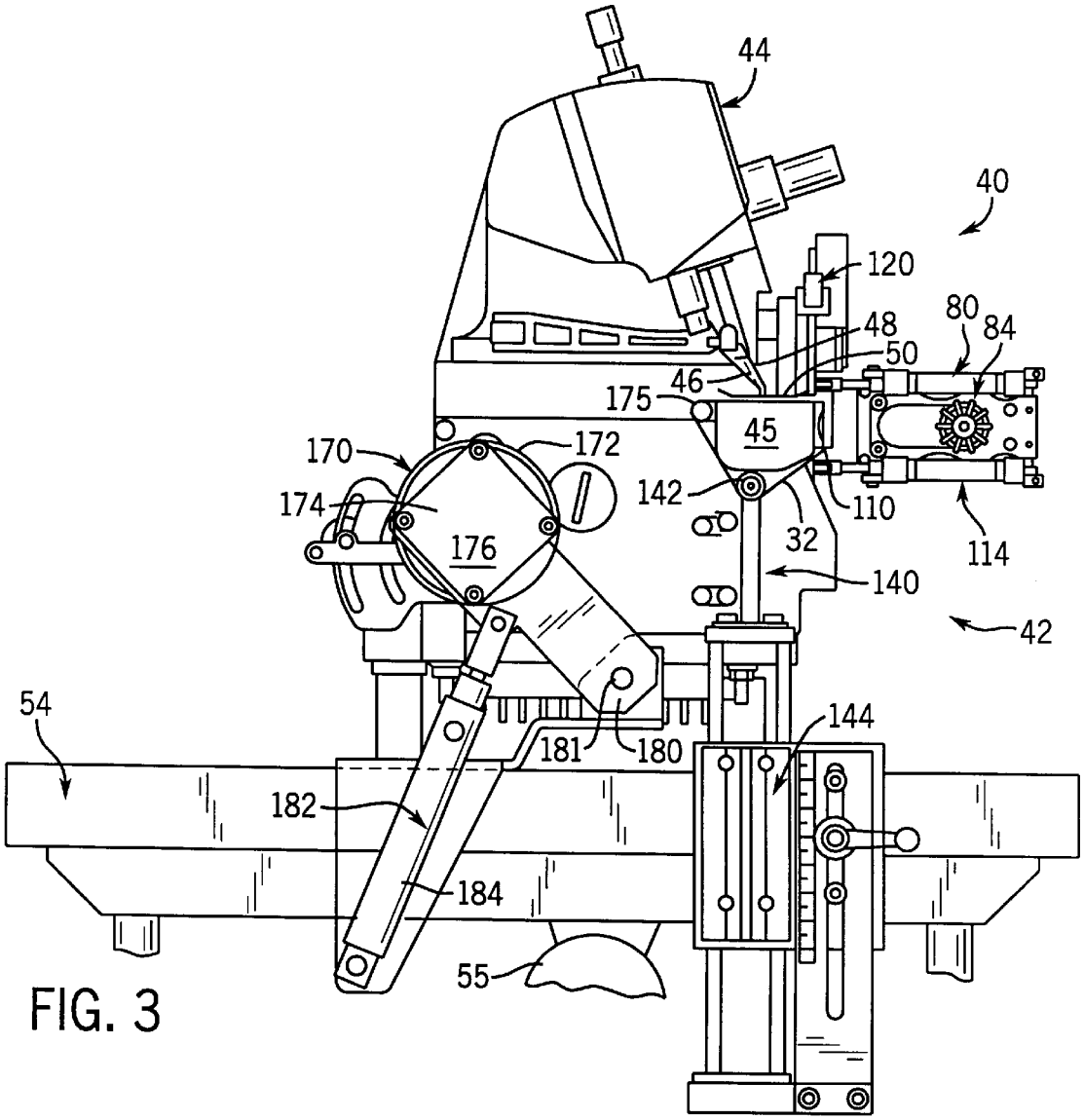
FIG. 3 is an end elevational view of one form of the automated sewing system of the present invention conditioned to accept insertion of a glove cuff thereinto.
Figure 4:
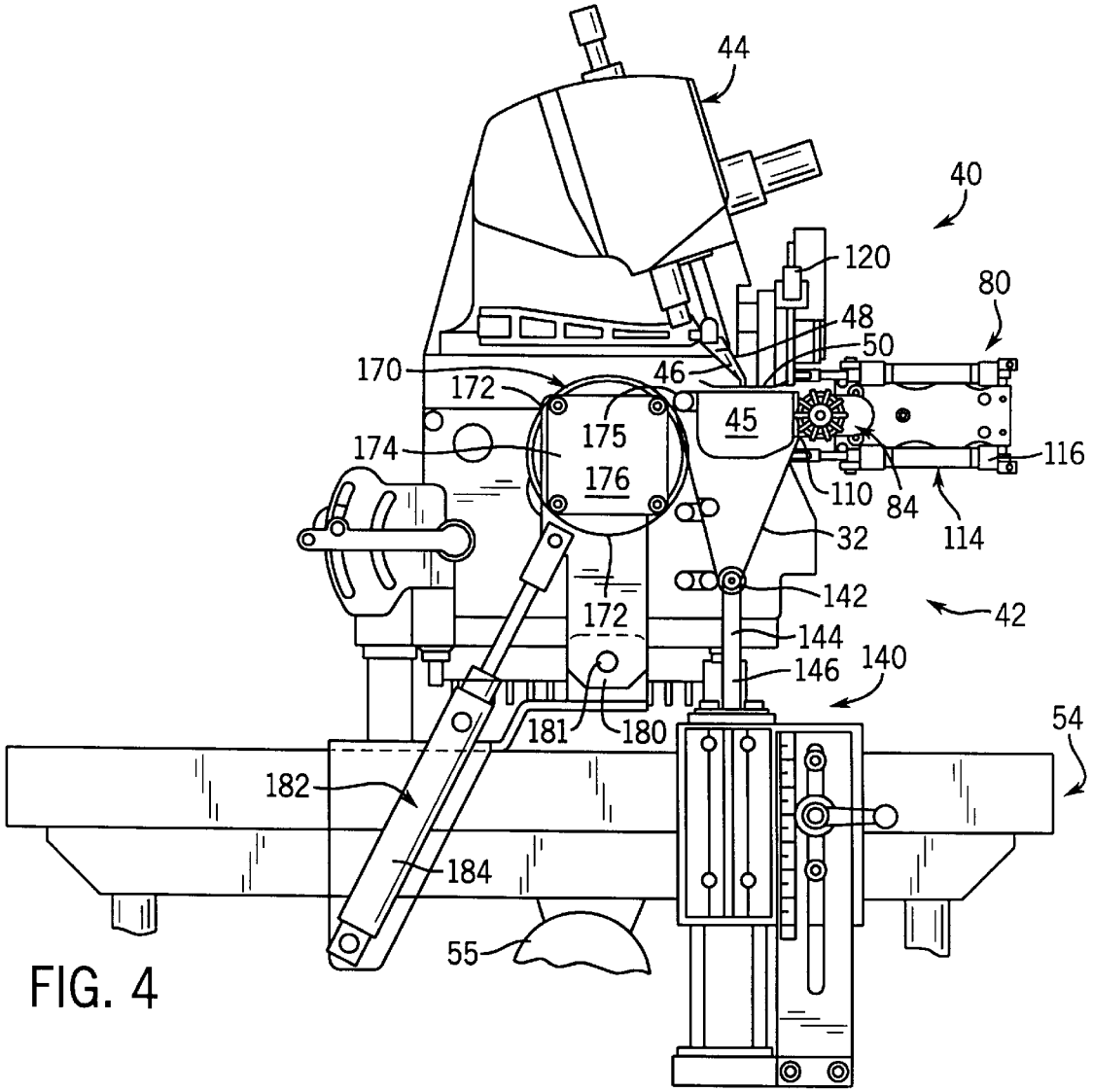
FIG. 4 is a end elevational view of that embodiment of the automated sewing system illustrated in FIG. 3 conditioned to effect automatic sewing of the glove cuff edge.

In accordance with the present invention, and as illustrated in FIGS. 3 and 4, there is provided an automated sewing system 40 for applying the a line of overedge stitching to a raw cuff edge of a knitted glove so as to inhibit the cuff edge 32 from inadvertently unraveling. The automated sewing system 40 includes a sewing station 42 whereat the cuff edge of the glove is sewn. The sewing station 42 is defined by a conventional overedge sewing machine 44 of a type known to those skilled in the art and preferably of the type sold by Juki/Union Special Corporation of Huntley, Illinois under Model No. MO100 Series cylinder bed overedge sewing machine. Reference may be made to U.S. Pat. No. 5,465,674 for a better disclosure of this machine. The disclosure of U.S. Pat. No. 5,465,674 which is applicable to the present invention is incorporated herein by reference. It should be noted, however, this invention can be practiced on any brand of cylinder bed overedge sewing machine without detracting or departing from the spirit and scope of the present invention.

Suffice it to say, and as shown in FIGS. 3 and 4, the sewing machine 44 includes a free ended cylinder bed 45 over which a portion of the glove to be sewn is placed and furthermore includes the requisite stitch forming or sewing instrumentalities 46 for applying the overedge stitching pattern 30 to a raw edge of the glove to create a sewn cuff edge thereby inhibiting the knitted cuff edge of the glove 20 from unraveling. The sewing instrumentalities 46 include at least a reciprocal thread carrying needle or needles 48 for the needle thread 38 of the overedge stitch pattern 30 (FIG. 2), an upper thread carrying looper (not shown) for the looper thread 36 of the overedge stitch pattern 30 (FIG. 2), and a lower thread carrying looper (not shown) for the looper thread 34 of the overedge stitch pattern 30 (FIG. 2).

The sewing machine 44 furthermore includes a downwardly biased presser foot 50 which operates in combination with a conventional feed mechanism (not shown). The sewing machine furthermore includes a suitable and conventional preferably solenoid actuated mechanism 52 (FIG. 10 ) for automatically raising and lowering the presser foot 50 in timed relation to operation of the sewing instrumentalities 46. Sewing machine 44 furthermore includes a conventional slotted throat plate 53 (FIG. 13) operable in combination with a conventional feeder mechanism (not shown) to cyclically advance the cuff edge of the glove to be sewn along a predetermined path extending through and relative to the sewing instrumentalities 46 on the machine 44. As is well known in the art, the throat plate 53 on the sewing machine 44 includes a free ended stitch tongue which acts as a knitting needle around which a thread chain can be formed.

Figure 13:
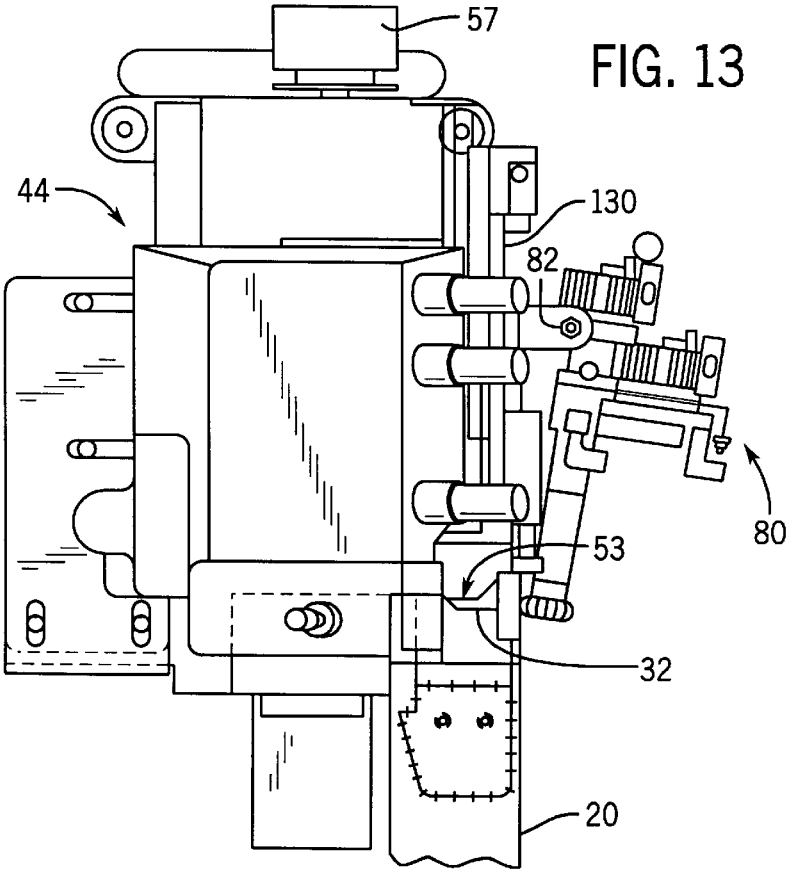
FIG. 13 is a top plan view of the present invention similar to FIG. 11 but where the seam has been removed from the stitch tongue of the throat plate of the sewing machine and the thread chain extending between the sewn cuff edge and sewing instrumentalities of the sewing machine are about to be cut or severed.
Figure 11:
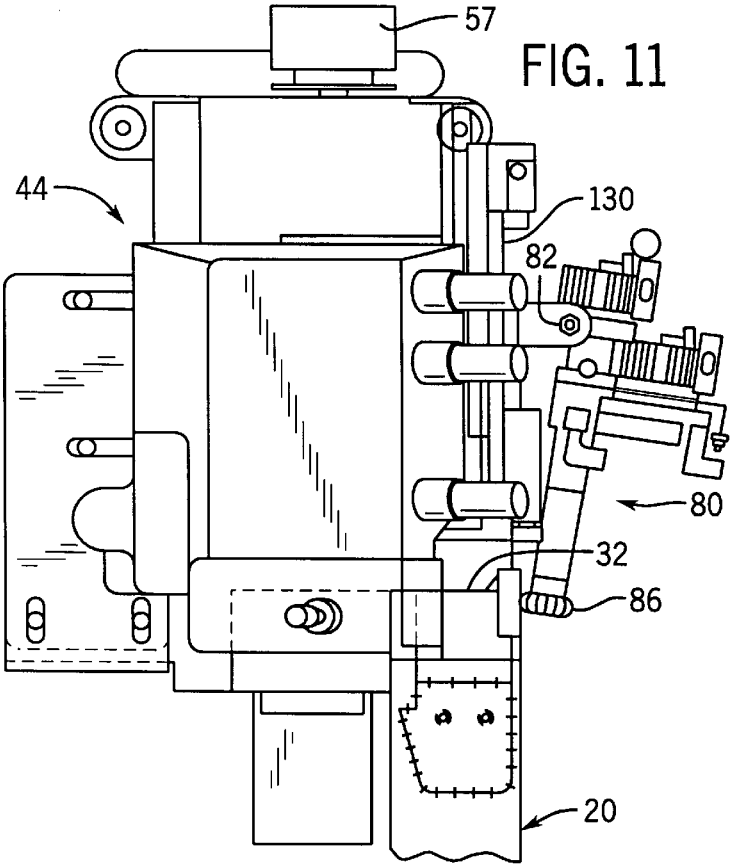
FIG. 11 is a top plan view of the automated system of the present invention operating along a sewn cuff edge and near completion of the sewing cycle.
Figure 12:
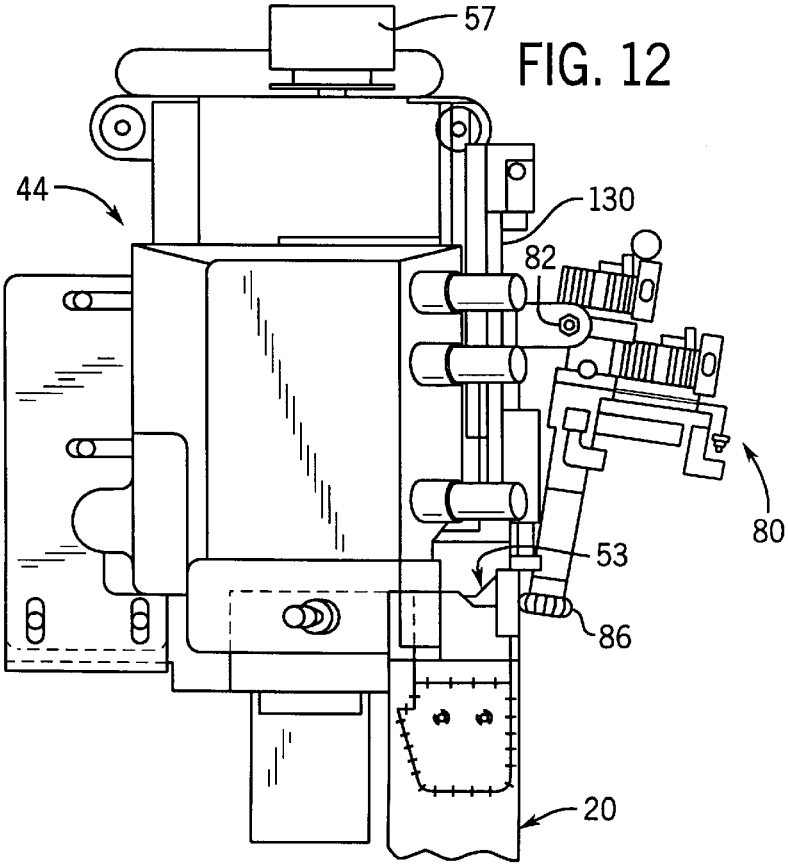
FIG. 12 is an top plan view of the present invention similar to FIG. 11 operating in an automated glove sewing cycle and at a point where the leading edge of the sewn cuff edge has been ejected from a predetermined path of travel and the seam is being removed from a stitch tongue of a throat plate of a sewing machine.

As schematically illustrated in FIGS. 3 and 4, sewing machine 44 is elevationally supported on a rigid frame 54. In the exemplary embodiment, the rigid frame 54 furthermore serves to support a selectively operated drive motor 55 which operably drives the sewing machine 44. As shown in FIGS. 11, 12 and 13, sewing machine 44 also includes a handwheel 57 which is rotationally driven about a fixed axis in response to operation of the drive motor 55 (FIG. 4). As will be appreciated by those skilled in the art, rotation of the handwheel 57, in turn, operates the other movable components of the sewing machine 44.

Figure 5:
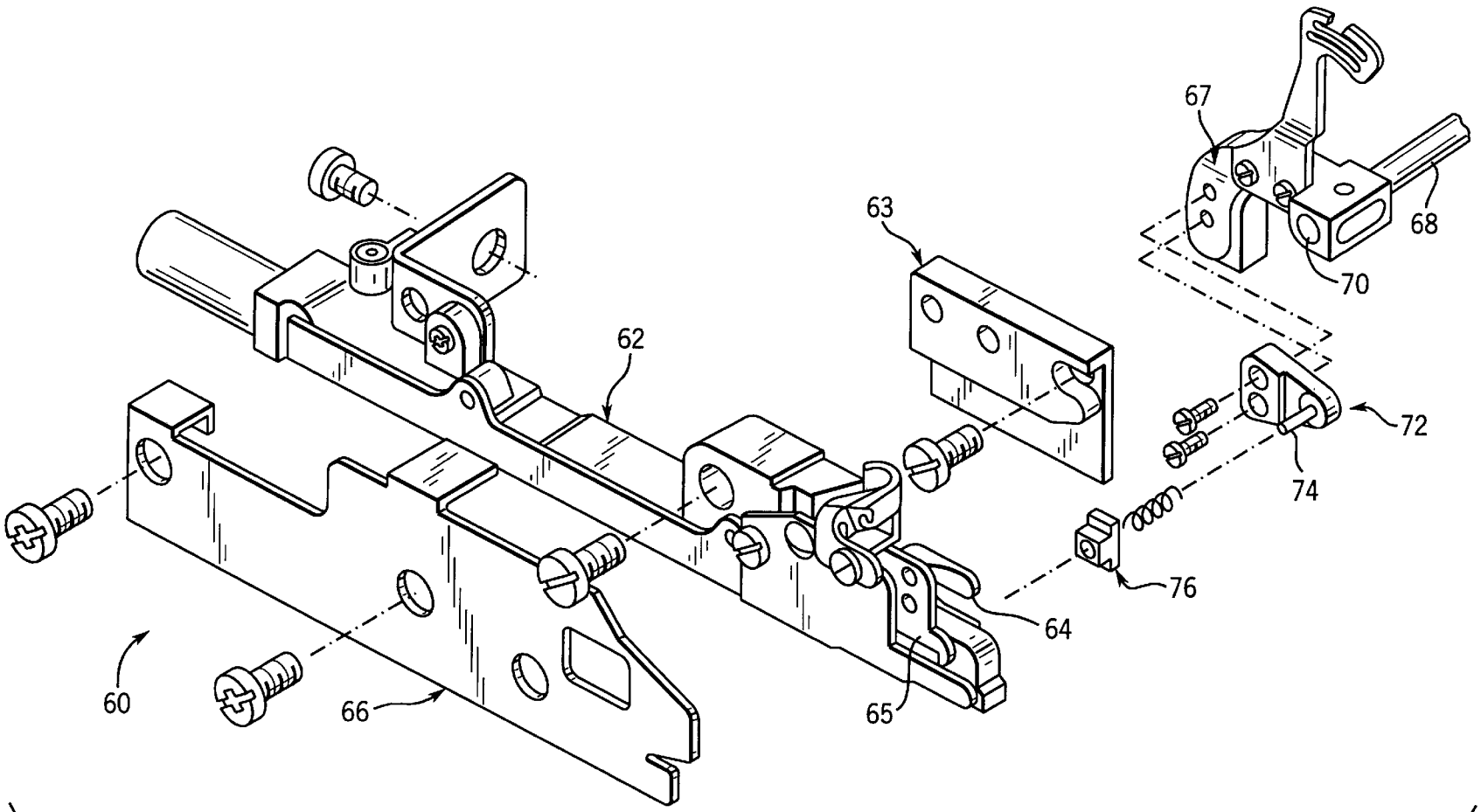
FIG. 5 is a perspective view of a driven thread chain cutting assembly useful in combination with the automated sewing apparatus of the present invention.

Turning to FIG. 5, the sewing machine 44 furthermore includes an automatic chain cutting assembly 60 positioned laterally adjacent the sewing instrumentalities 46 (FIGS. 3 and 4) of the sewing machine 44. The thread chain cutting assembly 60 preferably operates under the influence of a vacuum, preferably, controlled through a solenoid actuated vacuum source 61 (FIG. 10), such that loose threads are automatically drawn theretoward and is driven in timed relation to operation of the sewing machine 44. In the exemplary embodiment, the chain cutting assembly 60 is secured to the overedge sewing machine by screws extending through a knife mounting base 62 and a knife mounting plate 63 at a location to the right (as seen from the top) of the predetermined path of travel of the cuff edge. As shown, the knife mounting base 62 is configured as a hollow tube having one end opening behind or to one side of thread cutting blades 64 and 65. An opposite end of tube 62 is connected to a suitable vacuum source. A plate 66 serves as a cover for the cutting assembly 60.

In the exemplary embodiment, the cutting blade 64 of cutting assembly 60 is reciprocally driven while blade 65 remains stationary. As shown, a thread guide mount 67 is fixed to vertically reciprocating shaft 68 which extends through a bore 70 in mount 67. A drive member 72, having a free ended drive pin 74, is secured to and moves with the thread guide mount 67. The driving pin 74 carries a slide block 76 which operably engages and imparts reciprocating movements to the movable cutting blade 64. In operation, a thread chain is automatically drawn toward and between the blades 64 and 65 as a result of the vacuum created in the base 62 and is severed or cut by the blades 64, 65.

The automated sewing system 40 of the present invention further includes an apparatus 80 (FIGS. 3 and 4) arranged upstream of the sewing station 42 for automatically positioning or guiding the raw edge of the glove for movement along the predetermined path of travel and relative to the stitching instrumentalities 46 of the machine 44. In a preferred form of the invention, apparatus 80 furthermore operates to automatically remove the cuff edge of the work product from the predetermined path of travel and the line of stitching when the sewing cycle is completed. Apparatus 80 is of the type disclosed in U.S. Pat. No. 5,765,494; with that portion of the patented disclosure applicable to the present invention being incorporated herein by reference.

Suffice it to say, and as illustrated in FIGS. 6 and 7, and toward one end 81, the apparatus 80 is mounted to the sewing machine 44 for generally horizontal movements along a predetermined path of travel toward and away from the stitching instrumentalities 46 (FIG. 3) about a generally vertical axis 82 defined by a pivot pin 83. An opposite end of the apparatus 80 is provided with a material engaging driven head assembly 84.

In a preferred form, head assembly 84 includes a feeding wheel 85 comprised of a series of circumferentially spaced gripper wheels 86. In a preferred form, apparatus 80 further includes a first drive motor 87 and a second drive motor 88. In a most preferred form of the invention, the drive motors 87 and 88 are each configured as a stepper motor. The purpose of drive motor 87 is to drive feeding wheel 85 for rotation about a fixed axis 85'. As will be appreciated, rotation of wheel 85 about axis 85' serves to advance the cuff of the glove to be sewn in a feed direction toward the sewing instrumentalities 46 of the sewing machine 44. The purpose of drive motor 88 is to conjointly drive and rotate the gripper wheels 86.

In the embodiment illustrated, each gripper wheel 86 is mounted and configured for rotation about its own axis 86'. As will be appreciated, rotation of the gripper wheels 86 serves to move the cuff material in a direction generally normal to the direction of feed. That is, rotation of the gripper wheels 86 serves to move the cuff material toward or away from the predetermined path of travel of the cuff and relative to the sewing instrumentalities 46 of the sewing machine 44 depending on the operating direction of motor 88. The drive motors 87 and 88 of the guiding apparatus 80 can be controlled to rotate at specific speeds or for a specific number of rotations or fraction of a rotation. Thus, depending upon the diameter of the drive element and the drive ratios, the glove cuff can be advanced at a speed that is synchronized with the speed at which the overedge sewing machine 44 is advancing the cuff material through the sewing instrumentalities 46 of the machine 44.

As shown in FIG. 7, apparatus 80 includes a housing 90 which serves to mount drive motor 87 thereon. Motor 87 has an output shaft 91 extending therefrom. A pinion 92 is secured to shaft 91. Housing 90 furthermore rotatably supports an elongated hollow shaft 93 having a pinion 94 secured thereon. In a preferred form, shaft 93 is journaled in housing 90 by axially spaced bearings 95. The pinions 92 and 94 are operably interconnected to each other. In a preferred form, a toothed belt 96 serves to interconnect the pinions 92 and 94. As such, driven rotation of the output shaft 91 of motor 87 is transmitted to and thereby causes rotation of the hollow shaft 93. As shown, the feeding wheel 85 is connected to and rotates with shaft 93.

In the illustrated form, the feeding wheel 85 has a plurality of openings 97 formed therein. Each opening 97 is configured to rotatably accommodate a gripper wheel 86 for rotation in a direction extending generally parallel to the shaft 93. Each gripper wheel 86 is mounted for rotation on a shaft 98 carried by the feeding wheel 85. Each shaft 98 defines the axis 86' about which a gripper wheel 86 rotates.

As illustrated in FIG. 7, an elongated shaft 99 is journaled for rotation within the hollow shaft 93. Opposite ends of shaft 99 extend beyond the opposite ends of shaft 93. A worm gear 100 is securely mounted to one free end of the shaft 99. In the illustrated form, a peripheral edge 101 of each gripper wheel 86 is configured to engage with teeth on the worm gear 100 thereby establishing a positive drive connection therebetween.

Motor 88 also includes a rotatable output shaft 102. Output shaft 102 of motor 88 is operably connected to the end of shaft 99 opposite from the worm gear 100. Preferably, a suitable coupler 104 serves to interconnect the output shaft 102 of motor 88 with the free end of shaft 99. As such, and upon operation of motor 88, the rotation of worm gear 100 is transmuted into positive rotation of the gripper wheels 86 about each shaft 98 and in either direction illustrated by the arrow in FIG. 7.

In a preferred form, and as illustrated in FIG. 8, a plate 110 is mounted on a vertical surface of the cylinder bed 45 of the sewing machine 44 for operable engagement with the feeding wheel 85. As shown, plate 110 is provided with a generally cylindrically shaped concave surface configuration 112 that is complementary and cooperates with the peripheral edge of the gripper wheels 86 of the driven head assembly 84 of guiding apparatus 80. Preferably, surface 112 is aligned with the predetermined path of travel of apparatus 80.

During a sewing cycle, the cuff edge 32 of the glove 20 to be sewn passes over and is entrapped between surface 112 and the driven head assembly 84 of guiding apparatus 80. Of course, rotation of the feeding wheel 85 advances the cuff edge 32 toward the sewing instrumentalities 46 (FIG. 3) of the sewing machine 44 while rotation of the gripper wheels 86 laterally moves the cuff edge 32 passing between the driven head assembly 84 and plate 110 toward and away from the predetermined path of travel depending upon the direction of rotation of the output shaft 102 of drive motor 88.

As will be appreciated from above, the material engaging driven head assembly 84 of apparatus 80 can be moved toward and away from plate 110 as schematically illustrated in FIGS. 3 and 4. As illustrated in FIG. 3, when the cuff edge of the glove 20 is initially placed into the automated sewing apparatus 40 of the present invention, the material engaging driven head assembly 84 of apparatus 80 is disposed in spaced relation from the plate 110 to readily permit loading of the cuff edge for sewing. Thereafter, and during the automated sewing of the glove cuff edge 32, the material engaging driven head assembly 84 of apparatus 80 is arranged in operative combination with the plate 110 with the glove cuff edge to be operated upon being entrapped therebetween as illustrated in FIG. 4. Of course, at the completion of the automated sewing operation, the material engaging driven head assembly 84 of apparatus 80 is again required to be moved to a retracted position (FIG. 3) to allow automated ejection of the sewn cuff edge from the automated sewing apparatus 40 of the present invention.

In a preferred form of the invention, movement of the material engaging driven head assembly 84 of apparatus 80 along a predetermined path of travel and between positions is automatically controlled. As best illustrated in FIGS. 3 and 4, at least one driver 114 is provided to operably and positively move the material engaging driven head assembly 84 of apparatus 80 toward and away from plate 110 on the cylinder bed 45 of the sewing machine 44. Alternatively, the edge guiding apparatus 80 can be otherwise mounted so as to rely on gravity to allow the material engaging driven head assembly 84 to move toward the plate 110 and, thus, using a driver 114 for positively moving the driven head assembly 84 in a single direction.

In a preferred form, the driver 114 is configured as a pneumatically operated cylinder 116 which is controlled in a manner hereinafter described in detail. Of course, if the cylinder 116 is double acting, the material engaging driven head assembly 84 can be positively moved toward and away from the plate 110. Alternatively, the guiding assembly 80 can utilize a spring or other form of biasing mechanism for urging the material engaging driven head assembly 84.

As known in the art, operation of the material engaging driven head assembly 84 of the edge guiding apparatus 80 is controlled through suitable sensors 120 mounted in proximity to the sewing station 40. In the illustrated form, sensor 120 includes a conventional photocell. As is conventional, the photocell sensor 120 operates in combination with a highly reflective surface on the sewing machine. That is, the photocell 120 emit rays which are directed at the highly reflective surface or a surface having reflective tape applied thereto. As will be appreciated by those skilled in the art, the detection of the glove cuff edge 32 relative to the sensor 120 and thereby the predetermined path of travel of the cuff edge results in signals being produced by the sensor 120. As will be discussed below, the signals produced by the sensor 120 are used to control operation of the material engaging driven head assembly 84 of the edge guiding apparatus 80. As an alternative, diffuse type sensors can be used. Diffuse type sensors recognize characteristics of a particular type of surface they are intended to sense and do not require the presence of a highly reflective surface. As will be appreciated, other forms of edge guiding sensors could be equally applied to the present invention without detracting or departing from the spirit and scope of the present invention.

Figure 17:
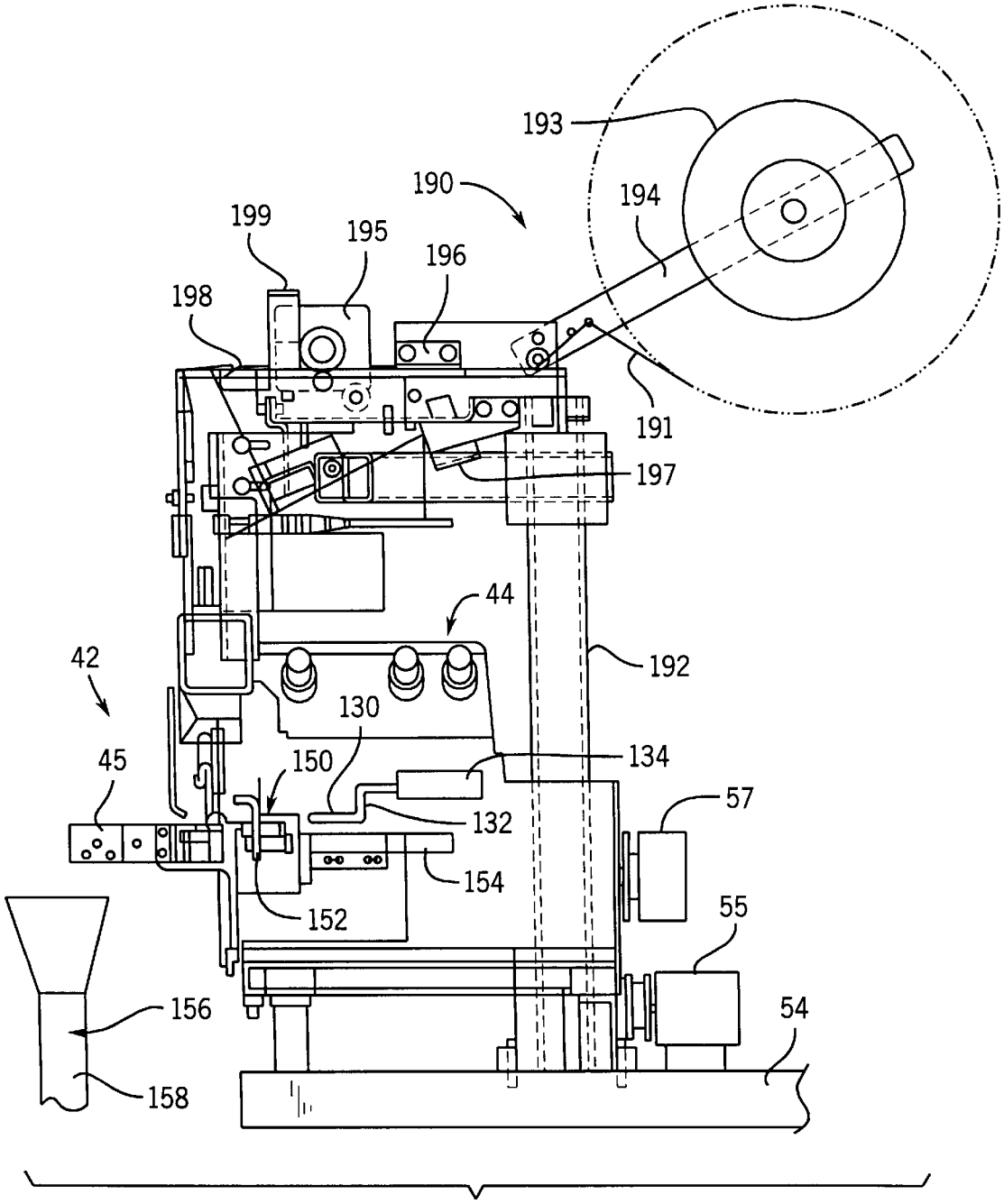
FIG. 17 is a front elevational view, with ceratin parts being deleted, of an alternative form of an automated sewing system according to the present invention and which is designed to automatically insert a label into the overedge seam of a knitted glove as illustrated in FIG. 15
Figure 18:
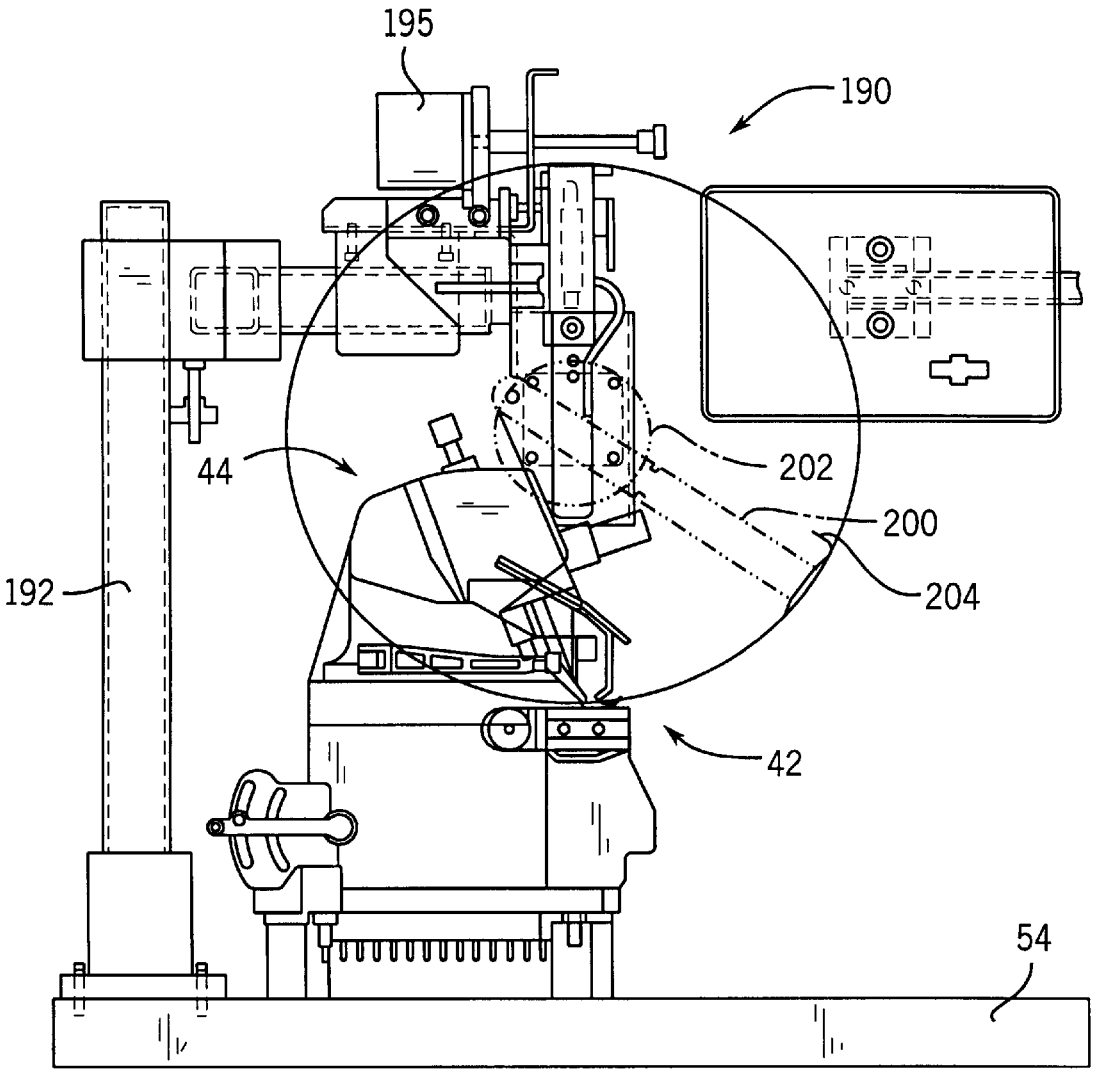
FIG. 18 is a side elevational view of that embodiment of the automated sewing system illustrated in FIG. 17.

As schematically illustrated in FIG. 17, and to supplement operation of apparatus 80 in automatically removing the sewn cuff edge from the predetermined path of travel after the sewn cuff edge has been sewn over a predetermined distance OS, the automated sewing apparatus 40 of the present invention can furthermore include an apparatus 130 arranged adjacent the sewing station for laterally moving the sewn cuff edge from the predetermined path of travel after the leading edge of the sewn cuff edge has been sewn over a predetermined amount or distance OS. In one form, apparatus 130 includes a glove cuff engaging member 132 and a driver 134 having a predetermined stroke. The purpose of the driver 134 is to extend the engaging member 132 across the predetermined path of travel of and into engagement with the sewn cuff edge to effectively eject the sewn cuff edge from the predetermined path of travel at an appropriate time in the automated sewing cycle. Preferably, driver 134 is in the form of a linearly distendable pneumatic cylinder 136. It should be appreciated, however, another suitable form of driver capable of removing or evicting the sewn cuff edge from the predetermined path of travel and at an appropriate time during the automated sewing cycle would equally suffice without detracting or departing from the spirit and scope of the present invention.

To accommodate automated sewing of gloves of certain type and/or size, the automated sewing apparatus 40 can furthermore include a glove expansion assembly 140. Returning to FIG. 3, the glove expansion assembly 140 is constructed and arranged to automatically expand the body portion 22 (FIG. 1) of the glove 20 to be sewn to a predetermined size thereby facilitating advancement of the cuff edge 32 through the sewing station 42.

As shown, the glove expansion assembly 140 includes a movable carrier 142 located immediately below the cylinder bed 45 of the sewing machine 44 and about which the cuff edge 32 is at least partially passed prior to expansion of the body portion 22 of the glove 20. Carrier 142 is generally horizontally disposed and extends in a direction generally normal to the predetermined path of travel of the cuff edge 32. The expansion assembly 140 further includes a driver 144 for moving the carrier 142 from a position whereat the carrier is disposed adjacent an underside of the cylinder bed 45 of the sewing machine 44 and thereby tensioning or slightly stretching the body portion 22 of the glove 20 to provide stability during the automated sewing process. Tensioning of the body portion 22 of the glove furthermore serves to straighten out the natural curve in the cuff 28 of the glove produced during the knitting process thus resulting in a neater appearance of the overedge stitching pattern 30. As will be appreciated, the driver 144 for the carrier can take any suitable form without detracting or departing from the spirit and scope of the present invention. In the illustrated embodiment, a linearly distendable pneumatic cylinder 146 is used to move the carrier between positions. As will be discussed in detail below, the driver 144 of expansion assembly 140 is operated in timed relationship relative to the sewing machine 44.

Figure 9:
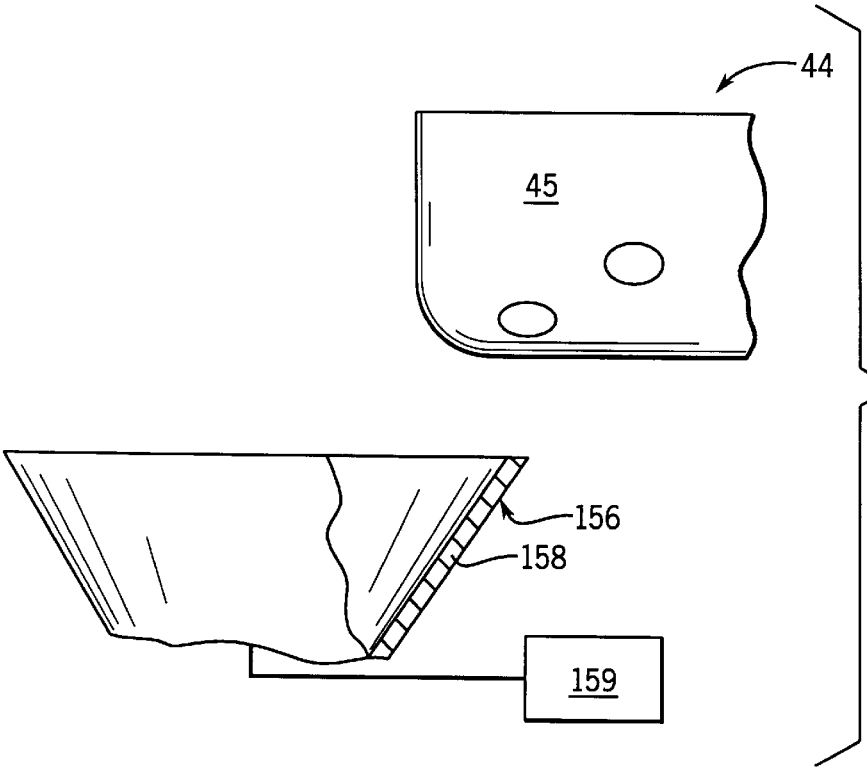
FIG. 9 is a enlarged schematic front elevational view of a portion of the automated sewing system used to automatically remove sewn work product from the sewing station of the present invention.

Returning to FIG. 17, the automated sewing system 40 of the present invention furthermore includes an apparatus 150 for automatically ejecting a glove with a sewn cuff edge from the sewing station 42. In the exemplary form illustrated, apparatus 150 includes a glove engaging member 152 which automatically operates in timed relation with the sewing cycle. In the illustrated form of the invention, the glove engaging member 152 is actuated as through use of a solenoid operated driver 154. In a most preferred form of the invention, the solenoid actuated glove engaging member 152 operates in combination with an additional apparatus 156 serving to positively remove the glove with a sewn edge from the sewing station 42. In one exemplary form shown in FIG. 9, apparatus 156 includes a vacuum operated tube 158 operated by a solenoid 159 and arranged proximate to and beneath the cylinder bed 45 of the sewing machine 44 and into which the glove with the sewn cuff edge is drawn after being ejected from the sewing instrumentalities 44.

As will be appreciated by those skilled in the art, apparatus 150 for automatically removing the glove from the sewing station following completion of the sewing cycle can take a myriad of different forms and shapes without detracting or departing from the spirit and scope of the present invention. For example, with slight redesign effort, apparatus 156 including the vacuum operated tube 158 could be movably positioned in elevated proximate relation relative to the cylinder bed 45 of sewing machine 44 so as to automatically draw a sewn glove thereinto following completion of the automated sewing cycle.

Figure 10:
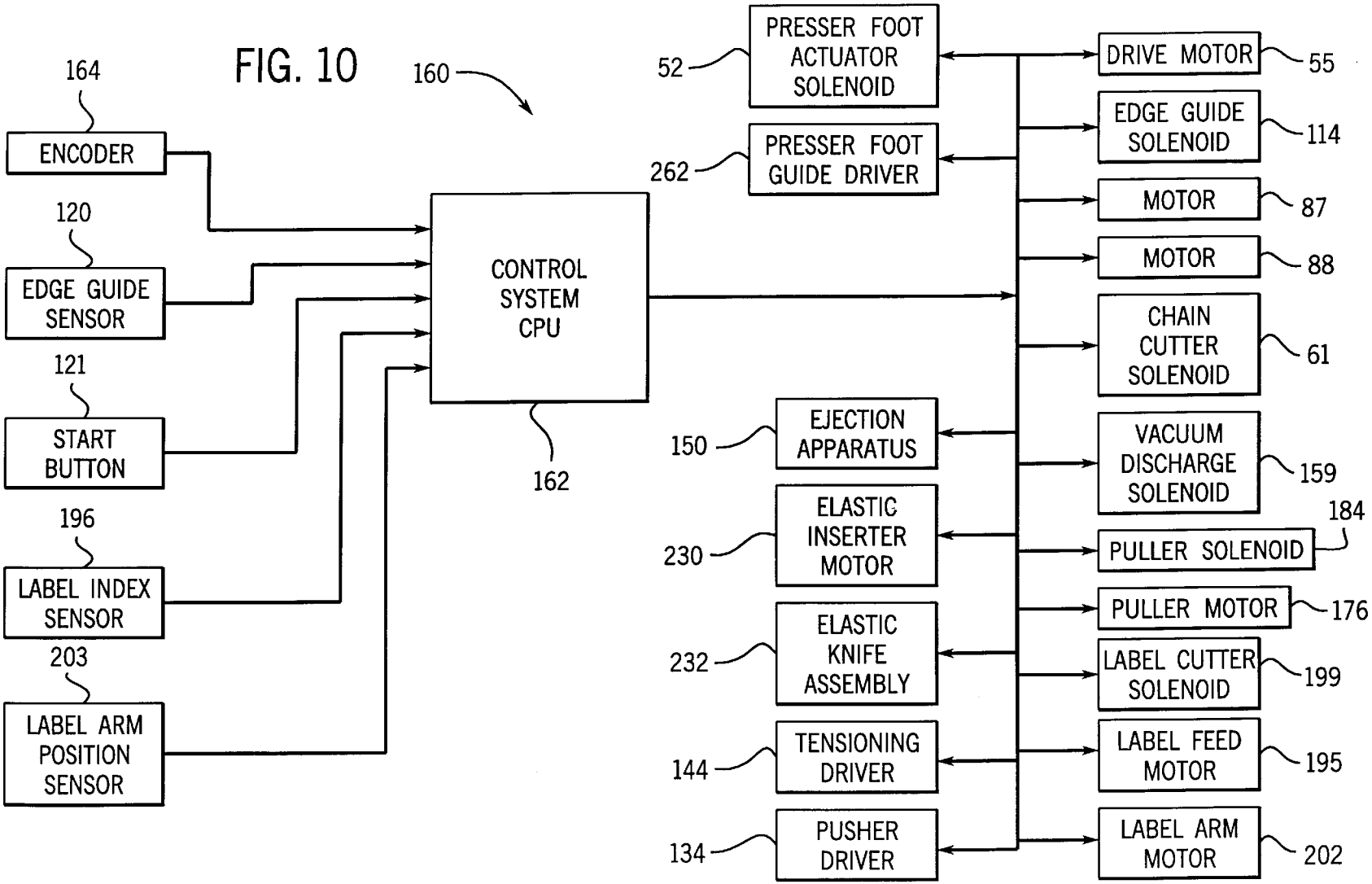
FIG. 10 is a simplified block diagram of a control system central processing unit of the automated apparatus of the present invention.

The automated sewing system 40 of the present invention furthermore includes a system 160 (FIG. 10) operably connected to and controlling the sewing machine 42, the guiding apparatus 80, the pusher apparatus 130, the glove expansion assembly 140, and the ejection apparatus 150. The control system 160 operates the sewing machine 44 to progressively advance the cuff edge of the glove through the sewing instrumentalities until a leading portion of the sewn cuff edge is sewn over a predetermined distance by the stitching instrumentalities 46 of the sewing machine 44. FIG. 10 is a schematic block diagram of the system 160 for controlling the automated sewing apparatus of the present invention.

System 160 includes a central processing unit 162 which receives inputs from several different sources, calibrates and analyzes the inputs, and directs outputs to various components thereby automatically controlling the overedge sewing pattern 30 applied to the cuff edge of the glove 20. The control system 160 furthermore includes programmable electronics for controlling operation of the sewing station and thereby the predetermined distance the leading sewn cuff edge is sewn over. For example, the control system 160 includes a shaft encoder or synchronizer 164 arranged in operable combination with the sewing machine 44 for monitoring revolutions of the hand wheel 57 and thereby delivering signals to the control system 160. As should be appreciated, the signals received from conventional means used to monitor the rotation of the hand wheel 57 of the sewing machine 44 are used to determine the exact location of the cuff edge during the automated sewing cycle. Other inputs to the control system 160 include signals received from the edge guide sensor 120, and a start button 121 for the automated apparatus 40.

The control system 160 also directs output signals to various components of the automated sewing system 40 of the present invention to automatically control the serging or oversewing of the cuff edge of the glove 20. More specifically, and as a function of the inputs received in the manner discussed above, the control system 160 directs output signals in a manner automatically controlling the sewing machine 44 including controlling the elevational disposition of the presser foot 50, the edge guiding apparatus 80, the pusher apparatus 130, the glove expansion assembly 140, and the glove ejection apparatus 150 all in timed relation relative to each other.

FIG. 3 schematically illustrates the position of the various components of the automated sewing apparatus prior to commencement of the automated sewing cycle. As illustrated in FIG. 3, the control system 160 conditions the sewing machine 44 and more specifically the solenoid actuated mechanism 52 to raise the presser foot 50 and allow the glove cuff edge to be positioned beneath the needle 48. As illustrated, the guiding apparatus 80 is conditioned such that the material engaging driven head assembly 84 is disposed in spaced relation relative to the surface 112 on plate 110 thereby allowing a glove cuff edge to be positioned on the automated sewing apparatus 40 for purposes of oversewing the cuff edge. In those embodiments so equipped, the apparatus 130 for laterally moving the sewn cuff edge away from the predetermined path of travel is in a retracted position so as to not interfere with advancement of the cuff edge through the sewing station 42. Moreover, and in those embodiment so equipped, the glove expansion assembly 140 is conditioned such that the carrier 142 is disposed closely adjacent an underside of the cylinder bed 45 of the sewing machine 44 thereby facilitating placement of the glove cuff edge to be sewn to be at least partially passed therealong prior to expansion of the body portion of the glove 20. Additionally, the control system 160 is programmed to automatically control the amount or extent of oversew OS to be applied to the sewn edge of the glove.

Once the glove cuff edge is positioned or loaded onto the cylinder bed 45 of the sewing machine 44, system 160 automatically controls the sewing system 40 of the present invention to automatically perform a sewing cycle as described below. That is, and following loading of a glove cuff edge into the sewing station 42 for serging the raw edge thereof, the control system 160 signals the solenoid actuated mechanism 52 to automatically lower the presser foot 50 into pressing engagement with the raw glove cuff edge. The control system 160 signals the guiding apparatus 80 to automatically swing from the position illustrated in FIG. 3 to the position illustrated in FIG. 4 as through operation of the driver 114. Notably, the pusher apparatus 130 remains in a retracted position. Additionally, the controller 160 preferably signals driver 134 of the glove expansion assembly 140 to expand the body portion 22 of the glove 20 to be sewn with a predetermined tension being placed thereon thereby facilitating advancement of the glove through the sewing machine 44.

In a preferred form of the invention, the controller 160 automatically begins the sewing cycle after receiving inputs from the various components that the glove edge is properly positioned relative to the stitching instrumentalities 46 of the sewing machine 44 (FIG. 11). The controller 160 then automatically advances the raw cuff edge of the glove 20 through the stitching forming instrumentalities 46 of the sewing machine and along a predetermined path of travel to create the sewn cuff edge 32. As the cuff edge advances through the sewing machine 44, the cuff edge approaching the stitching instrumentalities is automatically guided as with the guiding apparatus 80 along the predetermined path of travel. As will be appreciated from an understanding of the present invention, the sewing machine 44 is automatically controlled to progressively apply the interlocked or overlooked stitching pattern to the raw glove cuff edge as the cuff edge passes through the sewing instrumentalities 46 of the sewing machine 44 to create a sewn cuff edge thereby inhibiting the cuff edge from inadvertently unraveling.

Turning to FIG. 12, the controller 160 continues the automated sewing cycle until a leading portion of the sewn cuff edge has been sewn over a predetermined distance OS (FIG. 1). As will be appreciated by those skilled in the art, the predetermined oversew OS of the leading sewn edge of the glove cuff edge is determined by the stitch count and is controlled as by the controller 160. Of course, the stitch count is calculated as by monitoring operation of the sewing machine as through sensor or shaft encoder 164. As mentioned above, and because the electronics of the central processing unit 162 are programmable, the oversew OS applied to the sewn cuff edge can be regulated depending upon the particular application being performed.

After the leading sewn edge of the cuff is sewn over a predetermined amount or distance OS, the controller 160 temporarily ceases operation of the stitch forming instrumentalities 46 and the presser foot 50 is automatically raised. The motor 88 for the guiding apparatus 80 is then automatically operated by the control system 160 to cause the gripper wheels 86 on the head assembly 84 to automatically evict or eject the sewn cuff edge from the predetermined path of travel so as to establish a predetermined run off angle RA for the sewn glove cuff edge. Alternatively, and as illustrated in FIG. 12, the pusher apparatus 130 can be used to either replace or supplement operation of the guiding apparatus 80 in evicting the sewn cuff edge from the predetermined path of travel as by automatically extending toward and, ultimately, across the predetermined path of travel thereby engaging and automatically removing or ejecting the sewn cuff edge approaching the sewing instrumentalities from the predetermined path of travel to establish a predetermined run off angle RA for the sewn glove cuff edge. As will be appreciated, the predetermined run-off angle RA will be maintained as shallow as possible while consistent between sewn gloves as a result of duplicative operation of the drive motor 88 as controlled by system 160 and/or the predetermined stroke of the pusher apparatus 130.

After the cuff edge is automatically removed from the predetermined path of travel, the controller 160 automatically effects operation of the presser foot 50 to return to pressing engagement with the sewn cuff edge and the sewing machine 44 is automatically controlled to effectively sew off the workpiece at the predetermined run-off angle RA. The sewing machine 44 continues to automatically operate under the influence of the controller 160 thereby forming stitches on the stitch tongue of the throat plate 53. Accordingly, and since there is no material under the needle 48 as a result of the workpiece being sewn off, a thread chain extends between the sewn cuff edge of the glove and the stitch tongue on the throat plate 53. As the thread chain is produced, slack begins to build in the thread chain. When sufficient slack has been produced, the thread chain is automatically drawn into the vacuum operated thread cutting assembly 60 and the thread chain is automatically severed or cut a predetermined distance from the sewn cuff edge.

In the preferred form of the invention, and after the thread chain is automatically cut or severed, the apparatus 150 (FIG. 17) for automatically ejecting the glove from the sewing station 42 is enabled. With the illustrated embodiment, the glove engaging member 152 (FIG. 17) is enabled as through the controller 160 and the sewn glove is positioned to be further and positively withdrawn by apparatus 156 from the sewing station 42. The automated sewing cycle is now completed and a new sewing cycle is started when the operator places another glove onto the cylinder bed 45 of the sewing machine 44.

With relatively slight additions, the automated sewing system 40 of the present invention is capable of providing a different finish to the sewn cuff edge of the glove 20. More specifically, and as schematically illustrated in FIG. 14, the oversew OS on the glove cuff can be accomplished in the same manner discussed above while the overedge stitching used to lock the previous stitching remains "in-line" with the sewn edge as compared to having a run-off angle RA as discussed above. Accordingly, in this form of the invention, the run-off angle RA is zero. Moreover, this embodiment of the invention permits the resultant work product to have no trailing chain. Instead of having a trailing thread chain, as in the first embodiment, the resultant work product of this process has the three threads, i.e., the lower looper thread 34, the upper looper thread 36, and the needle thread 38 (FIG. 2) forming the overedge stitch pattern 30, severed or cut substantially flush as indicated at CF with the edge 32 of the glove cuff.

To accomplish a sewn cuff edge wherein the oversew OS terminates in-line with the remainder of the overedge sewing pattern 30 on the glove cuff edge and there is substantially no run-off angle, the above-described automated sewing system 40 is complimented with a puller apparatus, generally identified in FIGS. 3 and 4 by reference numeral 170. The puller apparatus 170 is arranged downstream of the sewing station 42.

The purpose of the puller apparatus 170 is to maintain the advancing speed of the cuff edge behind the presser foot 50 in synchronization with the speed of the cuff edge moving through the sewing instrumentalities 46 of the sewing machine 44. As a result of such synchronization, the puller apparatus 170 furthermore serves to keep the overedge seam in the predetermined path of travel. Notably, it is important to maintain the overedge seam closely adjacent to the driven cutting assembly 60 (FIG. 5) on the sewing machine 44 so the threads extending from the sewn cuff edge are maintained relatively short. It is also important, however, that the overedge seam does not get too close to the driven cutting assembly 60 or the threads of the overedge stitching pattern 30 could be cut along with the edge of the glove, thus, producing a defective work product.

In a preferred form, the puller apparatus 170 includes a puller roller 172 positioned rearwardly adjacent the sewing instrumentalities 46 of the sewing machine 44. The puller apparatus 170 furthermore includes a driver 174 for the puller roller 172. Driver 174 is preferably in the form of a stepper motor 176 capable of positively imparting driven rotational movements to the puller roller 172 in either rotational direction. The motor 176 is connected to and controlled by the control system 160. As seen in FIGS. 3 and 4, when the puller roller 172 is driven in a first or clockwise direction, the sewn cuff edge of the glove is moved along the predetermined path of travel and away from the stitching instrumentalities 46 of the sewing machine 44. In a most preferred form of the invention, the cylinder bed 45 of the sewing machine includes a free turning roller 175 disposed for tangential contact with the periphery of the puller roller 172.

In the preferred form, and as illustrated in FIGS. 3 and 4, the puller roller 172 is mounted toward the free end of a pivot arm 180. The opposite end of arm 180 is preferably pivoted, as at 181, to a lower end of the rigid frame 54. A driver 182, preferably in the form of a pneumatic cylinder 184, moves the pivot arm 180 and thereby the puller roller 174 toward and away from the cylinder bed 45 of the sewing machine 44. As will be appreciated from an understanding of the present invention, the control system 160 directs output signals in a manner automatically controlling the driver 174 for the puller roller 172 as well as the driver 182 for moving the puller roller 172 into an operative position relative to the stitching instrumentalities 46 on the sewing machine 44.

The methodology of operating the automated sewing apparatus or system 40 of the present invention to produce an oversew OS on the glove cuff which is "in-line" with the overedge stitching pattern 30 on the glove is substantially similar to that discussed above. That is, after the glove cuff is loaded onto the cylinder bed 45 of the sewing machine in the manner discussed above, the puller driver 182 moves the puller roller 172 into an operative position relative to the stitching instrumentalities 46 on the sewing machine 44. The automatic sewing cycle commences and the overedge stitching pattern 30 is applied to the glove cuff edge during the automated sewing cycle as discussed in detail above. During the automatic sewing cycle, the puller apparatus 170 serves to pull the sewn cuff edge through the sewing instrumentalities 46 of the sewing machine 44 while maintaining the sewn cuff edge in line with the predetermined direction of travel.

The controller 160 continues the automated sewing cycle until a leading portion of the sewn cuff edge has been sewn over a predetermined distance OS. As explained above with respect to the automated sewing cycle, after the leading sewn edge of the cuff is sewn over a predetermined amount or distance, the controller 160 temporarily ceases operation of the stitch forming instrumentalities 46 and the presser foot 50 is automatically raised. The sewn cuff edge approaching the sewing instrumentalities is automatically removed from the predetermined path of travel and the sewn glove cuff edge is thereby pulled off the stitch tongue of the throat plate 53.

After the cuff edge is automatically removed from the predetermined path of travel and the sewn seam of the glove cuff has been pulled from the stitch tongue of the throat plate 53, the controller 160 automatically effects operation of the presser foot 50 to return to pressing engagement with the sewn cuff edge. As a result of forcibly pulling the seam off the stitch tongue of the throat plate 53 while stitches are not being produced, three threads, including the lower looper thread 34, the upper looper thread 36 and at least one needle thread 38, are not formed into a chain. The three threads extend from the sewn cuff edge to the sewing instrumentalities 46 of the sewing machine 44.

At this time in the automated sewing cycle, these three threads are most likely pulled taut and cannot be drawn into the driven thread cutting assembly 60. Accordingly, the controller 160 again enables the sewing machine 44 to operate the sewing forming instrumentalities 46. Since that portion of the glove cuff approaching the stitching instrumentalities 46 of the sewing machine 46 has been laterally moved relative to the predetermined path of travel, there is no material beneath the reciprocal path of the needle 48. Accordingly, a thread chain is produced on the stitch tongue of the throat plate 53. As the thread chain is produced, slack begins to build in the three threads extending from the sewn seam on the glove cuff When sufficient slack has been produced, the three threads extending from the sewn cuff edge are drawn toward and, ultimately, into the driven cutting assembly 60 and severed close to the edge of the overedge seam on the sewn glove cuff 28.

Alternatively, the controller 160 operates the puller apparatus 170 to create slack in the three threads extending from the sewn seam on the glove cuff edge. That is, and after the sewn seam has been removed from beneath the presser foot 50 of the sewing machine 44, the controller operates the puller motor 176 in a second or reverse direction thereby creating slack in the three threads extending from the sewn seam on the glove cuff edge and at least that portion of the sewn seam extending between the puller apparatus 170 and the sewing instrumentalities 46 to allow the chain of stitches resulting from continued operation of the sewing machine 44 to be drawn toward and severed a predetermined distance from the cuff edge.

After the three threads extending from the sewn cuff edge have been severed, the apparatus 150 for automatically ejecting the glove from the sewing station 42 is automatically enabled by the controller 160. With the illustrated embodiment, the glove engaging member 152 is enabled and the sewn glove is positioned to be further and positively withdrawn by apparatus 156 from the sewing station 42. The automated sewing cycle is now completed and a new sewing cycle is started when the operator places another glove onto the cylinder bed 45 of the sewing machine 44.

As schematically illustrated in FIG. 15, for some uses, it is desirable to attach a label 188 to the glove 20. As schematically illustrated in FIG. 16, it is common to attach the label 188 to the outer surface 37 of the glove 20 by aligning an edge 189 of the label 188 with the edge 32 of the knitted glove and then including the edge 189 of the label in the overedge stitching pattern 30 applied to the glove 20.

As mentioned above, when a label is to be applied to a glove in the prior art manual method, and after sewing a portion of the seam on the edge of the knitted glove, the sewing operator must halt or stop the sewing operation at the location where the label is to inserted, pick up a label, and then insert the label under the needle and under the presser foot 50 of the sewing machine, and then continue the sewing operation to completion. As will be appreciated by those skilled in the art, this a tedious task requiring both a tremendous amount of skill, judgement and experience on the part of the operator. As will be appreciated, halting the sewing operation adds time and expense to the sewing operation. Moreover, requiring an experienced and skilled operator furthermore adds cost to the manual sewing operation. Even with an experienced and skilled operator, manual insertion of the label into the sewn seam varies from glove to glove and, thus, consistency between work products is lacking for even highly skilled operators cannot consistently succeed in properly positioning and applying a label to a glove edge using the manual process.

To effect automatic insertion and placement of a label 188 into the sewn cuff edge of a knitted glove, the automated sewing system 40 of the present invention can be furthermore modified to include a label inserter, generally represented in FIGS. 16 and 17 by reference numeral 190. The label inserter 190 is operated under the influence of and controlled by the control system 160. The purpose of the label inserter 190 is to automatically effect insertion of a label 188 into the sewn cuff edge of the glove with both consistency and preciseness and such that a centerline 189' of the label 188 (FIG. 15) extends generally normal to the line of overedge stitching, indicated generally in FIG. 14 by reference numeral 30', applied to the glove cuff edge. The label inserter 190 is preferably of the type described and illustrated in U.S. Pat. No. 5,315,946; the applicable portion of which is incorporated herein by reference.

Suffice it to say, the inserter 190 includes a stand 192 securely mounted to the frame 54 of the sewing station 42 in proximate relation relative to the sewing machine 44. A continuous supply of labels is preferably provided on a label roll 193 carried at the end of an arm 194. The labels are fed along a predetermined path by a label feed motor 195 from the roll 193 past a label detector 196 or sensor. As schematically represented in FIG. 10, label sensor or detector 196 provides input signals to the control system 160. Individual labels are cut from the continuous strip by a conventional cutting mechanism 198 operated under the influence of a solenoid 199 controlled by system 160.

The exemplary form of inserter 190 further includes label feed arm 200 driven in an arcuate path by a label arm motor 202. A conventional label arm sensor 203 (FIG. 10) continually monitors the disposition of the label feed arm 200 and provides input signals indicative of the disposition of the label feed arm 200 to the control system 160. As will be appreciated by those skilled in the art, the signals received by the control system 160 from sensor 203 are used to effect operation of the label inserter 190. Suffice it to say, sensor 203 may be of any suitable type capable of producing signals dependent upon the operable disposition of the label feed arm 203. As will be appreciated, the operable disposition of the label feed arm 200 can be monitored as through detecting the disposition of the arm 203 or through operation of the motor 202.

As disclosed in the above-mentioned U.S. Patent, the feed arm 200 has a label gripper 204 at its free end for picking up a label severed by cutting mechanism 198. In response to signals from control system 160, and at a predetermined stitch count during the automated sewing cycle, the feed arm 200 is automatically moved to deposit a label 188 under the presser foot 50. As such, the label 188 is automatically placed into the overedge sewing pattern 30 of the sewn cuff edge of the glove with heretofore unknown consistency and preciseness.

In still another form, it is desirable to elasticize the cuff edge such that the wrist portion 26 of the glove fits snugly about the wrist of the person wearing the glove 20. As illustrated in FIG. 19, a strip of tensioned elasticized material 210 is applied in overlying secured relation to the outer surface 37 of the knitted glove 20 and within the overedge seam 30 such that an edge 211 of the tensioned elastic strip 210 is disposed closely adjacent the cuff edge 32 of the glove cuff 28. In the illustrated embodiment, a predetermined width of strip 210 extends outwardly beyond the overedge seam 30 to provide a unique and pleasing aesthetic appearance to the elasticized cuff edge 28. Additionally, having a portion of the elastic strip 210 extend beyond the seam 30 yields a visual indication the elasticized strip is properly secured within the seam 30. Notably, the elasticized strip 210 furthermore yields a visual barrier to the underlying knitted material of the glove cuff.

Figure 20:
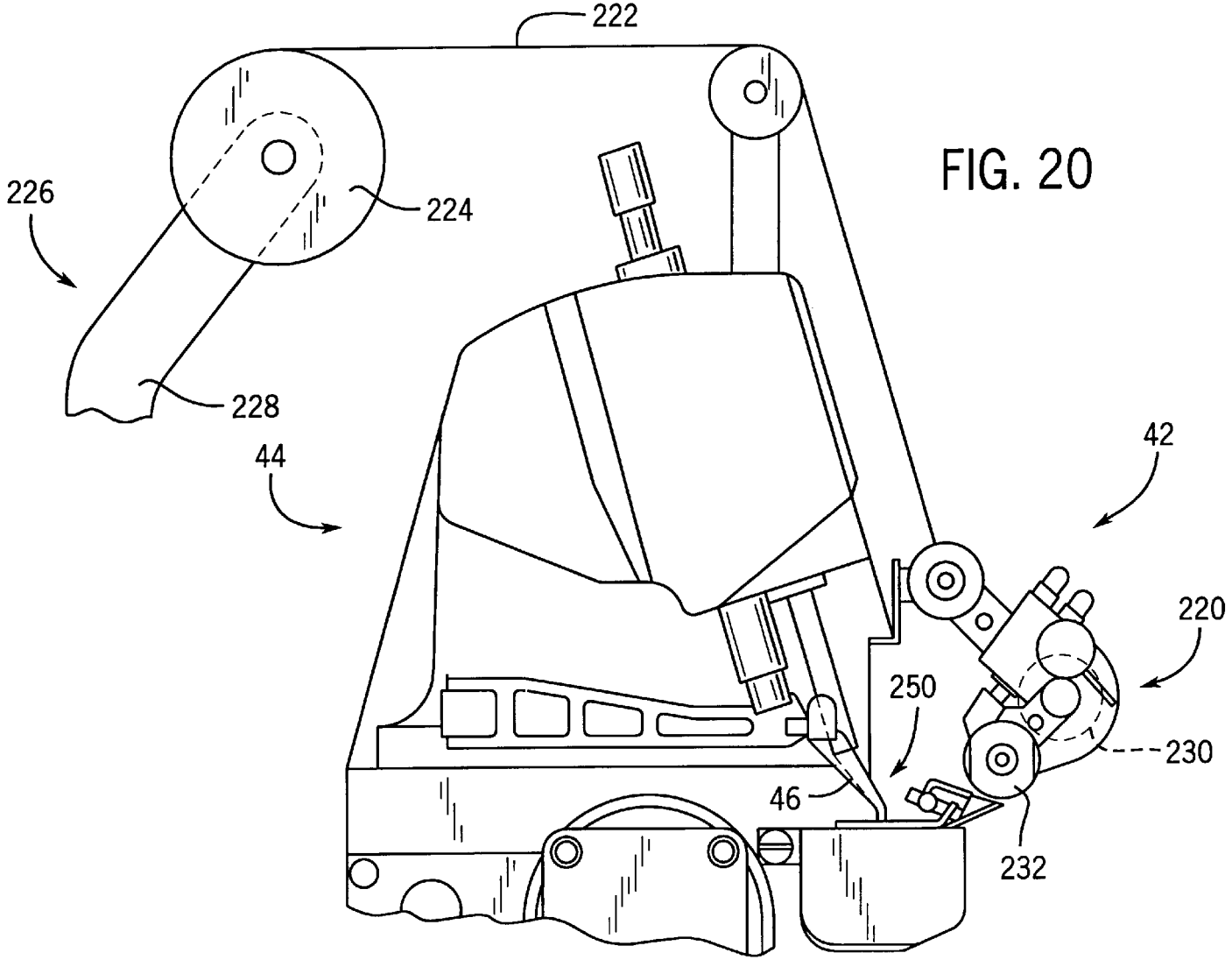
FIG. 20 is a front elevational view of an alternative form of an automated sewing system according to the present invention, with certain parts of the present invention illustrated above not being shown for purposes of clarity, and which is designed to automatically insert an elastic strip of material into the overedge seam of a knitted glove as illustrated in FIG. 19.

To effect automatic insertion and placement of an elastic strip 210 into the sewn cuff edge of a knitted glove, the automated sewing system 40 of the present invention can be furthermore modified to include an elastic inserter, generally represented in FIG. 20 by reference numeral 220. The elastic inserter 220 is a conventional and well known type elastic metering mechanism operably controlled by system 160 of the automated sewing system of the present invention.

Suffice it to say, and in the example illustrated in FIG. 20, the inserter 220 is fed a continuous supply of elastic strip material 222 preferably provided on a roll 224 carried by a stand 226. In the illustrated form of the invention, the stand 226 is securely mounted to the rigid frame 54 (FIG. 3) proximate to the sewing station 42 with the elastic roll of material 224 being disposed on an arm 228 forming part of the stand 226. The elastic strip material is fed along a predetermined path of travel to the elastic feeding or metering mechanism 220. In the illustrated form, the metering mechanism 220 includes a motor 230 which can be positively operated in either rotational direction under the influence of signals received from the control system 160 (FIG. 10). As will be appreciated, motor 230 controls the rate at which the elastic strip material is advanced. Additionally, the metering mechanism 220 includes a knife assembly 232 for cutting or severing the elastic strip into a predetermined length. Again, the knife assembly 232 of the metering mechanism operates under the influence of the control system 160 and at a predetermined stitch count during the automated sewing cycle.

The elastic strip 210 moves from the metering mechanism 220 and is presented to the sewing instrumentalities 46 of the sewing machine 44. During research, Applicants discovered the lateral disposition of the elastic strip changes when tension is applied thereto. That is, when tension is applied to the elastic strip passing from the metering mechanism and extending toward the sewing instrumentalities of the sewing machine, the width of the elastic strip changes. Accordingly, the lateral disposition of the elastic strip 210 relative to sewn seam 30 applied to the sewn cuff edge likewise changes. Responding to this problem, and returning to FIG. 19, another salient aspect of the present invention involves automatically controlling the lateral disposition of the elastic strip 210 as it moves from the metering mechanism 220 toward the sewing instrumentalities 46 on the sewing machine such that an edge of the elastic strip 210 extends a predetermined lateral distance, generally indicated as PD, past the edge of the seam 30 on the sewn cuff edge to provide the sewn cuff edge with a pleasing aesthetic appearance.

Figure 21:
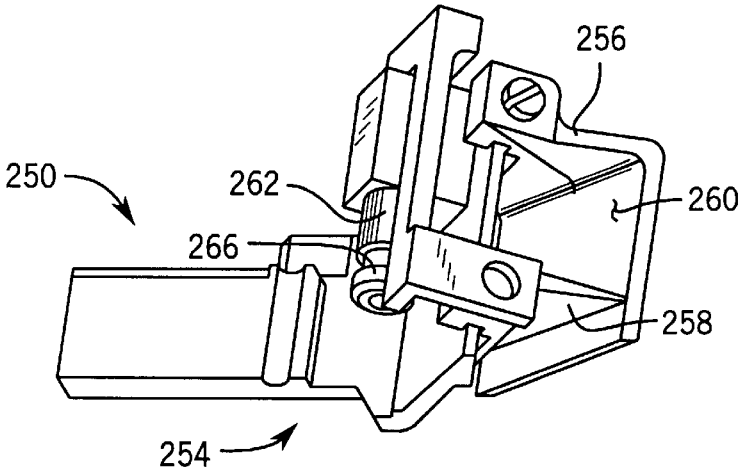
FIG. 21 is a perspective view of a presser foot assembly used in combination with the automated sewing system illustrated in FIG. 20.

To accomplish control over the lateral disposition of the elastic strip 210 as it moves between the metering mechanism 220 and the sewing instrumentalities, a unique design has been embodied in a presser foot assembly 250. As schematically illustrated in FIG. 21, the presser foot assembly 250 includes a presser foot 254 having a fixed guide 256 and a movable or slidable guide 258 which combine to define a passage 260 therebetween. As will be appreciated, the presser foot 254 operates and is substantially the equivalent of the presser foot 50 discussed above. Passage 260 receives and accommodates the elastic strip 210 passing from the metering mechanism 220 to the sewing instrumentalities 46 on the sewing machine 44 (FIG. 20). In a preferred form, the movable guide 258 is mounted for lateral sliding movement along the presser foot 254. In the illustrated form, a driver 262, preferably in the form of a linearly distendable fixed stroke pneumatic cylinder 266, is arranged in operable combination with and provides lateral movement to the guide 258. Operation of the driver 262 or cylinder 266 is regulated by the control system 160 (FIG. 10). As will be appreciated the guide 258 could be slidably operated and positioned through alternative means. For example, the movable guide 258 could be slidably positioned relative to the fixed guide as through a biasing spring without detracting or departing from the novel concept disclosed herein.

Figure 22:
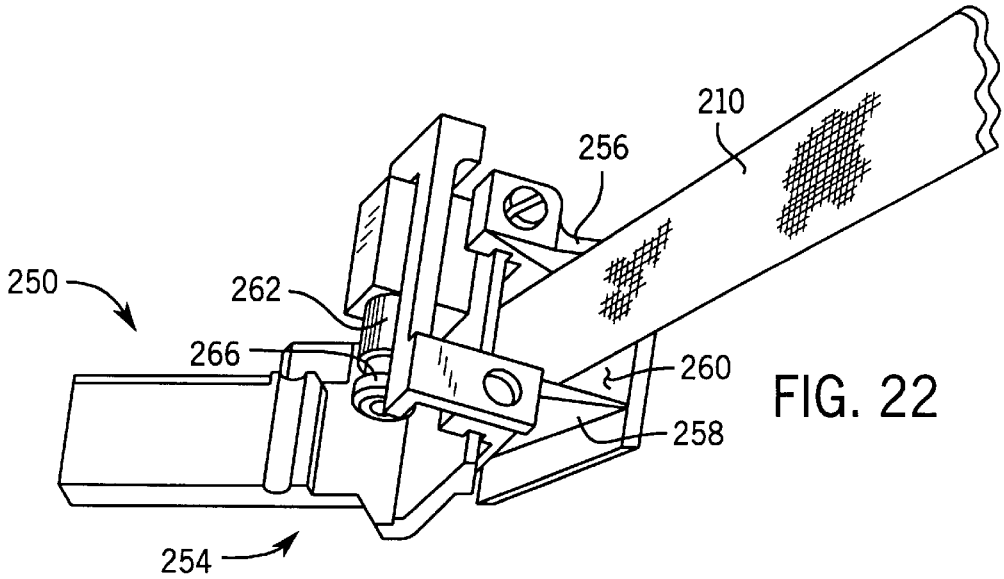
FIG. 22 is a view similar to FIG. 21 showing an elastic strip passing though the presser foot assembly.

As discussed in detail above, at the beginning of an automated sewing cycle, and as shown in FIG. 22, the presser foot assembly 250 is in an elevated or raised position to permit insertion of a raw edge of a glove cuff beneath the presser foot 254. In the exemplary embodiment, the control system 160 operates the driver 262 or cylinder 266 to a retracted position such that the movable guide 258 is advantageously disposed to readily permit insertion of the elastic strip 210 through the passage 260 and toward the sewing instrumentalities. Preferably, the elastic strip 210 is inserted prior to loading of the cuff edge into the automated sewing apparatus 40 thereby assuring the elastic strip 210 overlies the outer surface 37 of the cuff 26 as illustrated in FIG. 19.

Figure 23:
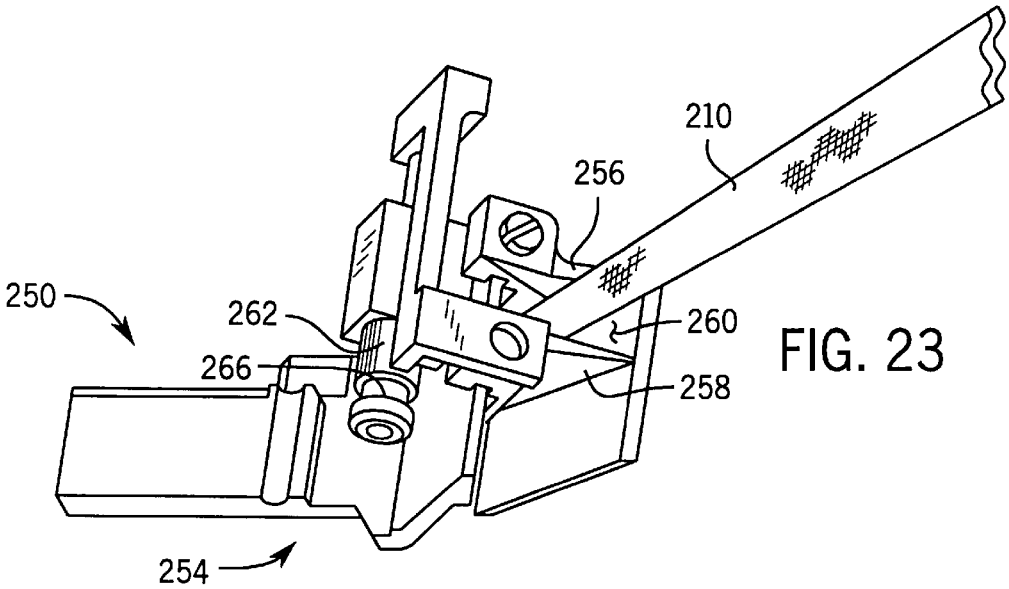
FIG. 23 is a view similar to FIG. 22 showing parts of the presser foot assembly in position to laterally guide the tensioned elastic strip.

In a preferred form, and after the elastic strip 210 is passed through the passage 260 of the presser foot assembly 250, the glove is loaded into the automated sewing system 40 of the present invention and, and as discussed above, the control system 160 conditions the solenoid actuated mechanism 52 (FIG. 10) to automatically lower the presser foot 254 into pressing engagement with the glove cuff. Substantially simultaneous with the lowering of the presser foot 254, the guide 258 moves toward a closed position relative to the fixed guide 256 (FIG. 23).

Following movement of the guide 258 to a closed position, the control system 160 (FIG. 10) then enables the sewing machine 44 to perform a programmable number of stitches in the glove cuff. After completing a predetermined number of stitches and thereby securing the elastic strip 210 to the glove cuff edge, the control system 160 reverses the motor 230 of the elastic metering mechanism 220 thereby tensioning the elastic strip 210 between the portion secured to the glove beneath the presser foot 254 and the elastic metering mechanism 220. The combination of the guide 258 being in a closed position and the tension on the elastic strip 210 narrows the width of the elastic strip and, preferably, allows the elastic strip 210 to be sewn at a substantially constant width around the entire curcumference of the cuff edge with the elastic strip extending the predetermined distance PD past the seam 30 on the cuff edge (FIG. 19).

Additionally, the control system 160 automatically controls the elastic metering mechanism 220 to maintain a substantially constant tension of the elastic strip 210 during the automated sewing cycle. After a predetermined number of stitches, the elastic trimming or cutting mechanism 232 is automatically operated by the control system 160 to sever the elastic strip 210 from the continues supply of strip material 222. Thereafter, the automated sewing system 40 of the present invention completes the sewing cycle and the glove having an elasticized sewn cuff edge is automatically removed from the sewing station 42.

As should be appreciated from the above, a new and unique automated sewing system and method for automatically applying a line of overedge stitching pattern to cuff edge of a knit glove has been disclosed. The overedge stitch pattern involves a predetermined oversew of the leading sewn cuff edge to "lock" the stitches in advance and thereby inhibit the cuff edge from inadvertently unraveling. The above-described system and process can also automatically apply a label in a precise and consistent manner such that the label is attached to the glove cuff edge through the overedge stitching pattern. Moreover, the above-described system and process can be used to automatically elasticize the sewn cuff edge involving a predetermined oversew of the leading sewn cuff edge to "lock" the stitches in advance and thereby inhibit the cuff edge from inadvertently unraveling. As a result of the present invention, the quality of the serging, the amount of oversew, the length of chain produced, the length of the cut chain remaining on the finished glove product, the cycle time, insertion of elastic into the sewn seam, and accurate insertion of a label are all automatically controlled and optimized. Moreover, the run-off angle of the overedge sewing pattern applied to the sewn glove cuff is either minimized or remains consistent between work products.

From the foregoing it will be observed that numerous modifications and variations can be effected without departing from the true spirit and scope of the novel concept of the present invention. Moreover, it will be appreciated the present disclosure is intended to set forth exemplifications of the invention which are not intended to limit or restrict the invention to the specific embodiments illustrated. Rather, the disclosure is intended to cover by the appended claims all such modifications and variations as fall within the scope of the claims.

What is claimed is:

1. An automated sewing system for applying stitching to a continuous cuff edge of a knit glove to inhibit said cuff edge from unraveling, with said knit glove having a body portion extending from said cuff edge, said automated sewing system comprising:

a sewing station whereat said cuff edge of said glove is sewn, said sewing station including a sewing machine having sewing instrumentalities for applying overedge stitching to a raw edge of the glove to create a sewn cuff edge thereby inhibiting said cuff edge from unraveling, said sewing machine further including a driven cutting assembly positioned adjacent said sewing instrumentalities;

a first apparatus arranged upstream of said sewing station for advancing said cuff edge along and automatically positioning the cuff edge relative to a predetermined path of travel; and a system operably connected to and controlling the first apparatus and said sewing machine to progressively advance the edge of said glove through said sewing machine until a leading portion of the sewn cuff edge is sewn over a predetermined distance by said stitching instrumentalities, with said system operating said first apparatus after the sewn cuff edge is sewn over said predetermined distance to automatically remove said sewn cuff edge from said predetermined path of travel while continuing to operate said sewing machine thereby creating a chain of stitches extending from said sewn cuff edge, and wherein said chain of stitches is drawn toward said cutting assembly and severed a predetermined distance from said sewn cuff edge.

2. The automated sewing system according to claim 1 further including a glove expansion assembly constructed and arranged to automatically expand the body portion of said glove to a predetermined size thereby facilitating advancement of said cuff edge through said sewing station.

3. The automated sewing system according to claim 2 wherein said expansion assembly includes a carrier about which said cuff edge is at least partially passed prior to expansion of said body portion of the glove.

4. The automated sewing system according to claim 3 wherein said expansion assembly further includes a driver for selectively moving said carrier of said expansion assembly toward and away from said stitching instrumentalities of said sewing machine.

5. The automated sewing system according to claim 4 wherein said driver of said expansion assembly is operated in timed relationship relative to said sewing machine.

6. The automated sewing system according to claim 1 wherein said system includes electronics for controlling operation of said sewing station and thereby the predetermined distance the sewn cuff edge is sewn over.

7. The automated sewing system according to claim 6 wherein the electronics of said system are programmable to yield selective control over the predetermined distance said sewn edge is sewn over.

8. The automated sewing system according to claim 6 wherein said sewing machine includes a rotatable handwheel, and wherein said electronics of said system monitors revolutions of said handwheel as said cuff edge is sewn.

9. The automated sewing system according to claim 1 further including an apparatus for automatically ejecting a glove with said sewn cuff edge from said sewing station.

10. The automated sewing system according to claim 1 further including a label inserting apparatus for automatically inserting a label at a predetermined position into the sewn cuff edge of the glove.

11. The automated sewing system according to claim 1 further including a pusher apparatus arranged upstream of said sewing station for laterally positioning said sewn cuff edge relative to said predetermined path of travel.

12. An automated sewing system for applying overedge stitching to a continuous raw cuff edge of a knit glove as said cuff edge moves along a sewing path, said knit glove having a body portion extending from said cuff edge, said automated sewing system comprising:

a sewing machine including stitching instrumentalities for sewing said overedge stitching along said raw cuff edge to create a sewn cuff edge thereby inhibiting said cuff edge from unraveling, said sewing machine further including a driven thread cutting assembly positioned adjacent said sewing instrumentalities;

a driven guiding apparatus arranged upstream of said sewing machine for advancing said cuff edge along and automatically positioning the cuff edge by lateral movement thereof relative to a predetermined path of travel;

a puller apparatus arranged downstream of the stitching instrumentalities of said sewing machine for operably pulling said sewn cuff edge from said sewing machine; and a system operably connected to and controlling said guiding apparatus, said puller apparatus, and said sewing machine to progressively advance the cuff edge through said machine until a leading portion of the sewn cuff edge is sewn over a predetermined distance, with said system operating said guiding apparatus to remove the sewn cuff edge from the predetermined path of travel after the leading portion of the sewn cuff edge has been sewn over, and with said system thereafter operating said sewing machine and said puller apparatus to create slack in the sewn cuff edge to allow a chain of overedge stitches extending from said cuff edge to be drawn toward and severed a predetermined distance from said sewn cuff edge.

13. The automated sewing system according to claim 12 wherein said puller apparatus comprises a puller roller positioned adjacent said sewing instrumentalities, and a driver for operably rotating said puller roller in a first direction to move the sewn cuff edge along the predetermined path of travel and through the sewing machine.

14. The automated sewing system according to claim 13 wherein said driver for operably rotating said puller comprises a motor capable of positively rotating said puller roller in opposite rotational directions.

15. The automated sewing system according to claim 14 wherein said system operates said driver for said puller roller after the sewn cuff edge is sewn over a predetermined distance to operably rotate said puller roller in a second direction, opposite to said first direction, to create slack in a portion of the sewn cuff edge extending between said puller roller and said sewing instrumentalities.

16. The automated sewing system according to claim 12 further including a glove expansion assembly constructed and arranged to automatically expand the body portion of said glove to a predetermined size thereby facilitating advancement of said cuff edge through said sewing station.

17. The automated sewing system according to claim 16 wherein said expansion assembly is operated in timed relationship relative to said sewing machine.

18. The automated sewing system according to claim 12 wherein said system includes electronics for controlling operation of said sewing station and thereby the predetermined distance the sewn cuff edge is sewn over.

19. The automated sewing system according to claim 18 wherein the electronics of said system are programmable to yield selective control over the predetermined distance said sewn edge is sewn over.

20. The automated sewing system according to claim 12 further including an apparatus for automatically removing a glove with said sewn cuff edge from said sewing station.

21. The automated sewing system according to claim 12 further including a pusher apparatus arranged upstream of said sewing station for laterally positioning said sewn cuff edge relative to said predetermined path of travel.

22. The automated sewing system according to claim 12 further including a label inserting apparatus for automatically inserting a label in a predetermined location into the sewn cuff edge of said glove.

23. An automated sewing system for attaching elastic to a cuff edge portion of a knit glove as said glove is turned and said cuff edge moves along a sewing path, said automated sewing system comprising:

a sewing station including a sewing machine and a driven apparatus for directing a tensioned elastic strip to stitching instrumentalities of said sewing machine to permit said tensioned elastic strip to be attached to said cuff edge, with said sewing instrumentalities applying a stitching pattern along said raw cuff edge to create an elasticized sewn cuff edge which inhibits said knit glove from unraveling, said sewing machine further including a driven thread cutting assembly positioned adjacent said sewing instrumentalities;

a driven guiding apparatus arranged upstream of said sewing machine for automatically positioning a raw cuff edge for movement along a predetermined path of travel relative to said stitching instrumentalities;

a puller apparatus arranged downstream of the stitching instrumentalities of said sewing machine for operably pulling said elasticized sewn cuff edge from said sewing machine; and a system operably connected to and controlling said guiding apparatus, said puller apparatus and said sewing machine including said driven apparatus to progressively advance the raw cuff edge through said machine until a leading portion of the sewn cuff edge is sewn over a predetermined distance, with said system operating said puller apparatus and sewing machine after the leading portion of the sewn cuff edge has been sewn over to create slack in at least that portion of the elasticized sewn cuff edge disposed between said puller apparatus and said sewing instrumentalities to allow a chain of overedge stitches extending from said elasticized and sewn cuff edge to be drawn toward and severed a predetermined distance from said elasticized sewn cuff edge.

24. The automated sewing system according to claim 23 wherein said sewing machine includes a presser foot assembly including a pair of laterally spaced elastic strip guides for directing the elastic strip to the sewing instrumentalities of the sewing machine, and wherein at least one of said guides is laterally movable under the influence of said system and in timed relation to operation of said sewing machine.

25. The automated sewing system according to claim 23 wherein said sewing machine includes a presser foot assembly configured to position one edge of said tensioned elastic strip a predetermined distance outside of the sewn cuff edge of said glove.

26. The automated sewing system according to claim 23 further including a pusher apparatus arranged adjacent said sewing machine for automatically and laterally moving said elasticized sewn cuff edge away from said predetermined path of travel after the leading sewn edge of said glove cuff has been sewn over said predetermined distance.

27. An automated method of sewing a continuous cuff edge of a knit glove to inhibit said cuff edge from inadvertently unraveling, said knit glove having a body portion extending from said cuff edge, said method of sewing comprising the steps of:

moving a raw edge of said glove cuff along a predetermined path of travel toward a sewing station, said sewing station including a sewing machine with stitching instrumentalities and a driven vacuum operated cutting assembly positioned adjacent said sewing instrumentalities for cutting threads;

positioning an edge of said glove automatically along said predetermined path of travel and relative to said stitching instrumentalities;

controlling said sewing machine to progressively apply an interlocked stitching pattern to the raw edge of the glove as said cuff edge passes through said sewing machine to create a sewn cuff edge thereby inhibiting the cuff edge from inadvertently unraveling, said application of interlocked stitches continuing until a leading portion of the sewn cuff edge is sewn over a predetermined distance by said stitching instrumentalities;

removing said sewn cuff edge from said predetermined path of travel after the sewn cuff edge is sewn over said predetermined distance; and continuing operation of said sewing machine after said sewn cuff edge is removed from said predetermined path of travel to create a chain of stitches extending from said sewn cuff edge, and wherein said chain of stitches is drawn toward said cutting assembly and severed a predetermined distance from said sewn cuff edge.

28. The automated method of sewing the knitted glove according to claim 27 further comprising the step of: expanding the body portion of the glove to a predetermined size in timed relation relative to operation of said sewing machine thereby facilitating movement of the cuff edge through said sewing machine.

29. The automated method of sewing the knitted glove according to claim 27 further comprising the step of: monitoring operation of the sewing machine to control the predetermined distance the leading edge of said sewn cuff edge is sewn over.

30. The automated method of sewing the knitted glove according to claim 27 further comprising the step of: programming operation of the sewing machine to control the predetermined distance the leading edge of said sewn cuff edge is sewn over.

31. The automated method of sewing the knitted glove according to claim 27 further comprising the step of: ejecting said knit glove with said sewn cuff edge relative to said sewing station after said chain of stitches is severed between the sewn cuff edge and the sewing instrumentalities.

32. The automated method of sewing the knitted glove according to claim 27 further comprising the step of: inserting a label at a predetermined location into the sewn cuff edge of said glove.

33. An automated method of sewing a continuous cuff edge of a knit glove to inhibit said cuff edge from inadvertently unraveling, said knit glove having a body portion extending from said cuff edge, said method of sewing comprising the steps of:

moving an edge of said glove cuff along a predetermined path of travel toward a sewing station, said sewing station including a sewing machine with stitching instrumentalities and a driven vacuum operated cutting assembly positioned adjacent said sewing instrumentalities for cutting threads;

positioning an edge of said glove cuff automatically along said predetermined path of travel and relative to said stitching instrumentalities;

pulling said cuff edge from said sewing machine in a first direction extending generally parallel to the predetermined path of travel of said cuff edge with a puller apparatus;

controlling said sewing machine to progressively apply an interlocked stitching pattern to the raw edge of the glove as said cuff edge passes through said sewing machine to create a sewn cuff edge thereby inhibiting the cuff edge from inadvertently unraveling, with said application of interlocked stitches continuing until a leading portion of the sewn cuff edge is sewn over a predetermined distance by said stitching instrumentalities;

evicting the cuff edge approaching said sewing instrumentalities from said predetermined path of travel after the leading edge of the sewn cuff edge has been sewn over said predetermined distance; and continuing operation of said sewing machine while creating slack in that portion of the sewn cuff edge between said puller and said sewing instrumentalities to create a chain of stitches extending from said sewn cuff edge, and wherein said chain of stitches is drawn toward said cutting assembly and severed a predetermined distance from said sewn cuff edge.

34. The automated method of sewing the knitted glove according to claim 33 further comprising the step of: expanding the body portion of the glove to a predetermined size in timed relation relative to operation of said sewing machine thereby facilitating movement of the cuff edge through said sewing machine.

35. The automated method of sewing the knitted glove according to claim 33 further comprising the step of: monitoring operation of the sewing machine to control the predetermined distance the leading edge of said sewn cuff edge is sewn over.

36. The automated method of sewing the knitted glove according to claim 33 further comprising the step of: programming operation of the sewing machine to control the predetermined distance the leading edge of said sewn cuff edge is sewn over.

37. The automated method of sewing the knitted glove according to claim 33 further comprising the step of: ejecting said knit glove with said sewn cuff edge relative to said sewing station after said chain of stitches is severed between the sewn cuff edge and the sewing instrumentalities.

38. The automated method of sewing the knitted glove according to claim 33 wherein the step of creating slack in that portion of the cuff edge extending between said puller apparatus and said sewing instrumentalities of said sewing machine is effected through operation of said puller apparatus in a second direction opposed to said first direction.

39. The automated method of sewing the knitted glove according to claim 33 further comprising the step of: inserting a label at a predetermined location into the sewn cuff edge of said glove.

40. An automated method of attaching elastic to a glove cuff edge of a knit glove having a body portion extending integral with and from said cuff edge, said automated method comprising the steps of:

moving a raw edge of said glove cuff along a predetermined path of travel toward a sewing machine having stitching instrumentalities and a driven vacuum operated cutting assembly positioned adjacent said sewing instrumentalities;

positioning said edge of said glove automatically along said predetermined path of travel and relative to said stitching instrumentalities of said sewing machine;

applying an interlocked stitching pattern to the cuff edge as said cuff edge passes through said sewing machine thereby creating a sewn cuff edge;

elasticizing the cuff edge of said glove with a relatively narrow tensioned strip of elasticized material, said tensioned strip of elasticized material being sewn into and positioned immediately adjacent to the cuff edge sewn by said sewing instrumentalities;

controlling said sewing machine to progressively advance the elasticized and sewn cuff edge through said sewing machine until a leading portion of the elasticized and sewn cuff edge is sewn over a predetermined distance by said sewing instrumentalities and a chain of stitches extends from the elasticized and sewn cuff edge to the sewing instrumentalities of said sewing machine, and with said chain of stitches extending from said elasticized and sewn cuff edge and said sewing instrumentalities being drawn toward and severed by said cutting assembly.

41. The automated method of sewing the knitted glove according to claim 40 further comprising the step of: expanding the body portion of the glove to a predetermined size in timed relation relative to operation of said sewing machine thereby facilitating movement of the cuff edge through said sewing machine.

42. The automated method of sewing the knitted glove according to claim 40 further comprising the step of: monitoring operation of the sewing machine to control the predetermined distance the leading edge of said sewn cuff edge is sewn over.

43. The automated method of sewing the knitted glove according to claim 40 further comprising the step of: programming operation of the sewing machine to control the predetermined distance the leading edge of said sewn cuff edge is sewn over.

44. The automated method of sewing the knitted glove according to claim 40 further comprising the step of: ejecting said knit glove with said elasticized and sewn cuff edge relative to said sewing station after said chain of stitches is severed between the elasticized and sewn cuff edge and the sewing instrumentalities.

45. The automated method of sewing the knitted glove according to claim 40 further comprising the step of: pulling said elasticized and sewn cuff edge in a first direction extending generally parallel to the predetermined path of travel of said cuff edge with a puller apparatus arranged downstream of said sewing instrumentalities thereby applying a tension to that portion of the elasticized and sewn cuff edge extending between said puller apparatus and said sewing instrumentalities.

46. The automated method of sewing the knitted glove according to claim 45 further including the step of: operating said puller apparatus in a reverse direction opposed to said first direction after said elasticized and sewn edge is sewn over said predetermined distance to create slack in that portion of the cuff edge extending between said puller apparatus and said sewing instrumentalities of said sewing machine to facilitate severance of said chain of stitches.

47. The automated method of sewing the knitted glove according to claim 40 further including the step of: removing said elasticized and sewn cuff edge from said predetermined path of travel after the sewn cuff edge is sewn over said predetermined distance while continuing operation of said sewing machine thereby creating said chain of stitches extending from said elasticized and sewn cuff edge.

48. The automated method of sewing the knitted glove according to claim 40 further comprising the step of: inserting a label at a predetermined location into the elasticized sewn cuff edge of said glove.

* * * * *